US011564438B1

(12) United States Patent
Daniel et al.

(10) Patent No.: US 11,564,438 B1
(45) Date of Patent: Jan. 31, 2023

(54) COLLAPSIBLE FOOTWEAR AND METHOD OF ALTERING A CONFIGURATION OF A COLLAPSIBLE SOLE TO A COMPACT FORM

(71) Applicant: Nir Daniel, Tel Aviv (IL)

(72) Inventors: Nir Daniel, Tel Aviv (IL); Galia Daniel, Tel Aviv (IL)

( * ) Notice: Subject to any disclaimer, the term of this patent is extended or adjusted under 35 U.S.C. 154(b) by 0 days.

(21) Appl. No.: 17/722,883

(22) Filed: Apr. 18, 2022

(51) Int. Cl.
*A43B 3/24* (2006.01)
*A43B 3/26* (2006.01)

(52) U.S. Cl.
CPC ..... *A43B 3/246* (2013.01); *A43B 3/248* (2013.01); *A43B 3/26* (2013.01)

(58) Field of Classification Search
CPC ..... A43B 3/24; A43B 3/246; A43B 3/248; A43B 3/26
USPC ..... 36/11.5, 100
See application file for complete search history.

(56) References Cited

U.S. PATENT DOCUMENTS 7,694,435 B1 * 4/2010 Kiser ..... A43B 3/24 36/11.5
9,089,184 B1 * 7/2015 Kiser ..... A43B 3/108
10,660,401 B1 * 5/2020 Pratt ..... A43C 11/002
11,051,577 B1 * 7/2021 Cheney ..... A43B 17/006
2005/0120591 A1 * 6/2005 Andrew ..... A43B 17/08 36/43
2006/0174513 A1 * 8/2006 Martinez ..... A43B 13/141 36/11.5
2007/0251126 A1 * 11/2007 Tvoua ..... A43B 3/108 36/97
2011/0016748 A1 * 1/2011 Soler ..... A43B 3/246 36/102
2011/0094125 A1 * 4/2011 Weightman ..... A43B 3/24 36/102
2012/0079745 A1 * 4/2012 Shalom ..... A43B 3/108 36/102
2014/0123517 A1 * 5/2014 Chen ..... A43B 3/248 36/102
2014/0310992 A1 * 10/2014 Shalom ..... A43B 3/246 36/103
2014/0373396 A1 * 12/2014 Chang ..... A43B 13/141 36/30 R
2015/0143722 A1 * 5/2015 Faggin ..... A43B 3/248 36/25 R
2017/0224054 A1 * 8/2017 Zeng ..... A43B 3/10
2020/0107605 A1 * 4/2020 Anderson ..... A43B 3/128
2020/0275732 A1 * 9/2020 Crary ..... A43B 1/0018
2020/0329813 A1 * 10/2020 Daniel ..... A43B 7/06

* cited by examiner

*Primary Examiner* — Marie D Bays
(74) *Attorney, Agent, or Firm* — Mark David Torche; Patwrite Law

(57) ABSTRACT

A collapsible footwear and a method of altering the configuration thereof into a compact form, configured for transportation, is described; the collapsible footwear includes a top part and collapsible sole including: a top sheet, bottom sheet, lateral support elements, laterally extending channels, top hinge elements, bottom hinge elements and stopper element, reversibly assuming collapsed and erected configurations; the method includes providing a collapsible sole, providing at least one top part, compressing the collapsible sole to assume a collapsed configuration and altering the configuration of the collapsible sole to assume an erected configuration.

19 Claims, 13 Drawing Sheets

COLLAPSIBLE FOOTWEAR AND METHOD OF ALTERING A CONFIGURATION OF A COLLAPSIBLE SOLE TO A COMPACT FORM

TECHNICAL FIELD

In general, the present invention pertains to the art of collapsible sole for collapsible footwear. In particular, the invention relates to a collapsible sole and method of altering a configuration of a collapsible footwear in a compact form configured for transportation.

BACKGROUND ART

It is believed that the current state of the art is represented by the following patent literature: U.S. Ser. No. 10/986,895, U.S. Pat. Nos. 8,011,119, 6,895,693, U.S. Ser. No. 10/750,818, CN111053322 and KR200351287.

U.S. Ser. No. 10/986,895 from the same co-inventors that is believed to represent the closest prior art discloses a compressible footwear that may include a compressible sole and a compressible upper part that is mechanically coupled to the compressible sole. The compressible sole consisting essentially of multiple compressible cells that are made of a flexible material and have top openings and bottom openings. The multiple compressible cells span over at least a majority of the compressible sole and are configured to undergo a compression while substantially maintaining a thickness of the compressible sole.

U.S. Pat. No. 8,011,119 discloses a personally adjustable footwear with at least one sole layer including: a toe portion, a heel portion, and an intermediate portion. The intermediate portion has openings passing vertically through the layer so that the intermediate portion is elastically flexible to allow relative longitudinal displacement of the toe portion and the heel portion to vary a length of the layer without significant variation in a thickness of the layer. A retention mechanism selectively fixes the toe and heel portions in any of a number of relative positions. Also disclosed are implementations with insertable and removable segments, and with elongated elements sliding in channels.

SUMMARY OF THE INVENTION

The following summary of the invention is provided in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

The invention was made in view of the deficiencies of the prior art and provides systems, methods and processes for overcoming these deficiencies. According to some embodiments and aspects of the present invention, there is provided a collapsible footwear configured for transportation in a compact form including: a collapsible sole including: a top sheet, extending essentially across entire surface area of the sole; a bottom sheet, extending essentially across entire surface area of the sole; a plurality of lateral support elements, extending between the top sheet and the bottom sheet, in which the lateral support elements extend essentially along an entire width of the sole; a plurality of laterally extending channels formed in-between the lateral support elements and in-between the top and bottom sheets; a plurality of top hinge elements operationally connecting the top sheet and the plurality of lateral support elements of the collapsible sole, in which the top hinge elements are configured to sustain a partial rotation of the plurality of lateral support elements relative to the top sheet; a plurality of bottom hinge elements operationally connecting the bottom sheet and the plurality of lateral support elements of the collapsible sole, in which the bottom hinge elements are configured to sustain a partial rotation of the plurality of lateral support elements relative to the bottom sheet; at least one stopper element disposable between the upper sheet and the bottom sheet; in which the collapsible sole is characterized by reversibly assuming: a collapsed configuration, in which the plurality of laterally extending channels is essentially collapsed and the top sheet is at least one member selected from the group consisting of: in a proximity to the bottom sheet and spaced apart from the bottom sheet; an erected configuration, in which the at least one stopper element stabilizes the plurality of laterally extending channels in an open conformation, whereas the top sheet is at least one member selected from the group consisting of: spaced apart from the bottom sheet and includes a straight planar form; at least one top part, selected from the group consisting of: a collapsible top part; a removable top part.

In some embodiments, the at least one top part is the removable top part, further includes a plurality of connecting elements, configured for readily connecting the collapsible sole with the at least one top part.

In some embodiments, the at least one stopper element disposable between the upper sheet and the bottom sheet embodies at least one shape selected form the group consisting of: a rectangular shape, linear shape, trapezoidal shape and cylindrical shape.

In some embodiments, the plurality of laterally extending channels is essentially collapsed, by forming an acute angle between the plurality of lateral support elements and the top sheet and bottom sheet, thereby disposing the top sheet within proximity to the bottom sheet.

In some embodiments, in the erected configuration, the plurality of lateral support elements is disposed essentially perpendicularly to the top sheet and the bottom sheet.

In some embodiments, the at least one stopper element is insertable within at least one of the laterally extending channels, thereby affixing the collapsible sole in the erected configuration, and in which the at least one stopper element is retrievable from the at least one of the laterally extending channels, thereby rendering the collapsible sole alterable into the collapsed configuration.

In some embodiments, the plurality of lateral support elements are positioned relative to the upper sheet and the bottom sheet at an angle selected form the group consisting of: perpendicular angle, acute angle, obtuse angle.

In some embodiments, the collapsible sole includes a frontal portion, a centrical portion and a rear portion, in which the collapsible sole to assume: a folded configuration, in which in the collapsed configuration, the bottom sheet of the collapsible sole is folded about the centrical portion, so that a frontal portion of the bottom sheet is disposed adjacently to a rear portion of the bottom sheet; an unfolded configuration, in which in the erected configuration, the bottom sheet of the collapsible sole is straightened, so that the frontal portion of the bottom sheet forming an approximately straight angle relative to the rear portion of the bottom sheet; in which the centrical portion accommodating a mechanism configured to affix the collapsible sole in the erected configuration.

In some embodiments, the collapsible sole includes a frontal portion, a centrical portion and a rear portion, in which the centrical portion accommodating the at least one stopper element including an essentially trapezoid shape, in which the collapsible sole is configured to assume: a folded configuration, in which top hinge elements are spaced apart from a top portion of the trapezoid shape, and an unfolded configuration, in which the posterior top hinge elements are adjoined to the top portion of the trapezoid shape.

In some embodiments, each one of the laterally extending channels accommodates a stopper element of a linear shape extending essentially along an entire width of the collapsible sole, selected from the group consisting of: a top stopper hinge element including a connection between a top portion of the at least one stopper element and the top sheet, and a bottom stopper element including a connection between a bottom portion of the stopper element and the bottom sheet.

In some embodiments, the collapsible sole includes a corrugated shape, in which in the collapsed configuration, the top sheet and the bottom sheet of the collapsible sole are foldable are disposed adjacently to the stopper element.

In some embodiments, in the erected configuration, the top sheet and bottom sheet of the collapsible sole assume an essentially planar form.

In accordance with some aspects and embodiments of the present invention, there is provided a method of altering a configuration of a collapsible footwear into a compact form, configured for transportation, including: providing a collapsible sole including: a top sheet, extending essentially across entire surface area of the sole; a bottom sheet, extending essentially across entire surface area of the sole; a plurality of lateral support elements, extending between the top sheet and the bottom sheet; in which the lateral support elements extend essentially along an entire width of the sole; a plurality of laterally extending channels formed in-between the lateral support elements and in-between the top and bottom sheets; a plurality of top hinge elements operationally connecting the top sheet and the plurality of lateral support elements of the collapsible sole, in which the top hinge elements are configured to sustain a partial rotation of the plurality of lateral support elements relative to the top sheet; a plurality of bottom hinge elements operationally connecting the bottom sheet and the plurality of lateral support elements of the collapsible sole, in which the bottom hinge elements are configured to sustain a partial rotation of the plurality of lateral support elements relative to the bottom sheet; at least one stopper element disposable between the upper sheet and the bottom sheet; providing at least one top part, selected from the group consisting of: a collapsible top part; a removable top part; compressing the collapsible sole to assume a collapsed configuration, in which the plurality of laterally extending channels is essentially collapsed; in which the top sheet is in a proximity to the bottom sheet or including a corrugated shape; altering a configuration of the collapsible sole to assume an erected configuration, in which the at least one stopper element stabilizes the plurality of laterally extending channels in an open conformation; in which the top sheet is spaced apart from the bottom sheet and includes an essentially planar shape.

In some embodiments, in which the at least one top part is the removable top part, in which the collapsible sole including a plurality of connecting elements, configured for readily connecting the collapsible sole with the at least one top part, the method further includes connecting the collapsible sole with the at least one top part.

In some embodiments, the method further includes inserting the at least one stopper element into the at least one of laterally extending channel, thereby affixing the collapsible sole in the erected configuration.

In some embodiments, further includes forming an acute angle between the plurality of lateral support elements and the top and bottom sheets, in the collapsed configuration, thereby disposing the top sheet within proximity to the bottom sheet.

In some embodiments the collapsible sole includes a frontal portion, a centrical portion and a rear portion, further includes: folding the collapsible sole to assume a folded configuration, in which in the collapsed configuration, the bottom sheet of the collapsible sole is folded about the centrical portion, so that a frontal portion of the bottom sheet is disposed adjacently to a rear portion of the bottom sheet; altering a configuration of the collapsible sole to assume an unfolded configuration, in which in the erected configuration, the bottom sheet of the collapsible sole is straightened to assume an essentially planar shape, so that the frontal portion of the bottom sheet forming an approximately straight angle relative to the rear portion of the bottom sheet.

In some embodiments, the collapsible sole includes a frontal portion, a centrical portion and a rear portion, in which the centrical portion accommodating the at least one stopper element including an essentially trapezoid shape, further includes: folding the collapsible sole to assume a folded configuration, in which in the folded configuration, posterior top hinge elements are spaced apart from a top portion of the trapezoid shape; altering a configuration of the collapsible sole to assume an unfolded configuration, in which in the erected configuration, the posterior top hinge elements are adjoined to the top portion of the trapezoid shape.

In some embodiments, each one of the laterally extending channels accommodates the stopper element of a linear shape extending essentially along an entire width of the collapsible sole, further includes connecting a top portion of at least one top stopper element to the top sheet of the collapsible sole, and connecting a bottom portion of at least one bottom stopper element to the bottom sheet of the collapsible sole.

Definitions

The term "compact form" as referred to herein is to be construed as including any shape configured for transportation. In some embodiments the term "compact form" is to be construed as assuming a size which is less by approximately 30 to 90 percent, relative to the size in a deployed configuration. In some embodiments the term "compact form" is to be construed as portable and particularly as manually portable. In some embodiments the term "compact form" is to be construed as having a miniature size relatively to an average and/or normal sized footwear.

The term "racetrack-shaped" as referred to herein is to be construed as including any shape including two straight parallel sides connected by semi-circular ends, such as an oval shape.

The term matching or a term similar thereto as referred to herein is to be construed as having a cross-sectional area and/or shape of a component equal or essentially similar to a cross-sectional area and/or shape of another component. It should be acknowledged that the components may only to be similar in the cross-sectional areas and/or shapes, to satisfy the term matching or similar, so long as the cross-sectional areas of the components can be mated and/or inserted into each other and/or the combination thereof essentially fits together and/or occupy essentially the same space.

The term structured as referred to herein is to be construed as including any geometrical shape, exceeding in complexity a plain linear shape or a shape embodying simple cylindrical, elliptical or polygonal contour or profile. A more complex shape, a plain linear shape or a shape embodying simple cylindrical, elliptical or polygonal contour or profile, constitutes an example of structured geometry.

The term modular, as referred to herein, should be construed as a stand-alone unit. The term modular inter alia means a standardized unit that may be conveniently installed or deployed without significant impact to the environment. The term modular, however, doesn't necessarily mean providing for ease of interchange or replacement. The term modular is optionally satisfied by providing for ease of at least onetime deployment or installation.

The term readily connectable, as referred to herein, should be construed as a standardized unit that may be conveniently connected to other components of the system. The term readily connectable, however, doesn't necessarily mean readily disconnectable or removable. The term readily connectable is optionally satisfied by providing for ease of at least onetime connection or coupling.

By operationally connected and operably coupled or similar terms used herein is meant connected in a specific way (e.g., in a manner allowing fluid to move and/or electric power to be transmitted) that allows the disclosed system and its various components to operate effectively in the manner described herein.

The terms firm rigid, or stiff, as referred to herein, are to be construed as having rigidity modulus value, otherwise referred to as the shear modulus, of 4800 MPa or more. Materials are considered to be firm rigid, or stiff but not tensile, when such materials are incapable of being efficiently elastically flexed or bent. Stiff materials, such as steel, are defined as having rigidity modulus value well exceeding 4800 MPa.

The terms pliable or pliant, as referred to herein, are to be construed as having high tensile strength and capable of being efficiently elastically flexed or bent but not being resilient and incapable of being efficiently stretched or expanded. The term tensile or tensile strength, as referred to herein, is to be construed inter alia as a shortcut of the known term ultimate tensile strength, frequently represented acronym as UTS, meaning an intensive property of a material or structure to withstand loads tending to elongate, namely to resist tension, defined as the maximum stress that a material can withstand while been stretched or pulled before sustaining breaking, substantial deformation and/or necking before fracture, such as nylon, relating to essentially non-ductile materials, having UTS value ranging between about 600 and 1000 MPa or more, but not including rigid, firm or stiff materials.

The terms elastic or resilient, as referred to herein, are to be construed as having tensile strength lower than aforesaid tensile strength of pliable or pliant material and optionally being capable of efficiently stretching or expanding, relating inter alia to essentially ductile materials, having UTS value lesser than about 600 MPa.

In the specification or claims herein, any term signifying an action or operation, such as: a verb, whether in base form or any tense, gerund or present/past participle, is not to be construed as necessarily to be actually performed but rather in a constructive manner, namely as to be performed merely optionally or potentially.

The term substantially as used herein is a broad term, and is to be given its ordinary and customary meaning to a person of ordinary skill in the art (and is not to be limited to a special or customized meaning), and refers without limitation to being largely but not necessarily entirely of that quantity or quality which is specified.

The term essentially means that the composition, method or structure may include additional ingredients, stages and or parts, but only if the additional ingredients, the stages and/or the parts do not materially alter the basic and new characteristics of the composition, method or structure claimed.

As used herein, the term or is an inclusive or operator, equivalent to the term and/or, unless the context clearly dictates otherwise; whereas the term and as used herein is also the alternative operator equivalent to the term and/or, unless the context clearly dictates otherwise.

It should be understood, however, that neither the briefly synopsized summary nor particular definitions hereinabove are not to limit interpretation of the invention to the specific forms and examples but rather on the contrary are to cover all modifications, equivalents and alternatives falling within the scope of the invention.

DESCRIPTION OF THE DRAWINGS

The present invention will be understood and appreciated more comprehensively from the following detailed description taken in conjunction with the appended drawings in which.

Figure 1A:
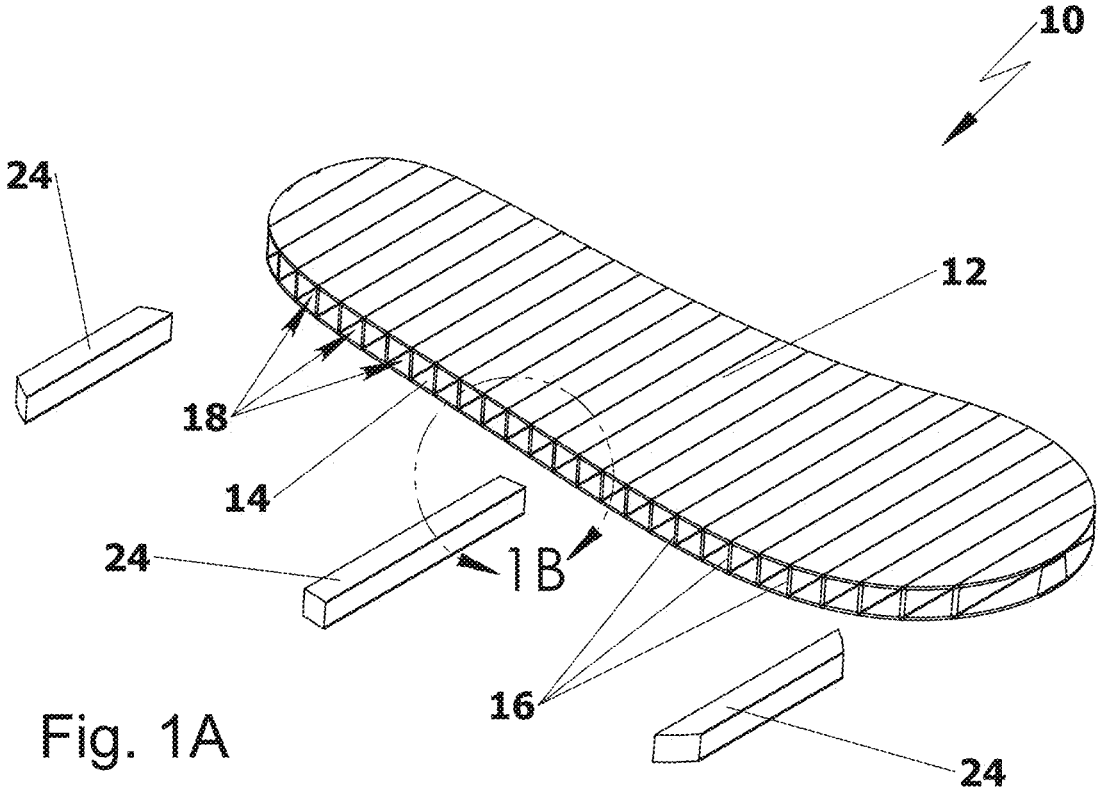
FIG. 1A is a perspective view of a collapsible sole of a collapsible footwear with at least one stopper element, according to an embodiment of the present invention.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DISCLOSURE OF EMBODIMENTS

Illustrative embodiments of the invention are described below. In the interest of clarity, not all features of actual implementation are described in this specification. It should be appreciated that various features or elements described in the context of some embodiment may be interchangeable with features or elements of any other embodiment described in the specification. Moreover, it will be appreciated that for the development of any actual embodiment, numerous implementation-specific decisions must be made to achieve the developers' specific goals, such as compliance with technology- or business-related constraints, which may vary from one implementation to another, and the effort of such a development might be complex and time-consuming, but would nevertheless be a routine undertaking for those of ordinary skill in the art having the benefit of this disclosure.

In accordance with some preferred embodiments of the present invention, reference is now made to FIG. 1A to 1E, showing collapsible sole 10 of a collapsible footwear, configured for transportation in a compact and/or portable form. The collapsible sole of the embodiment of FIG. 1A to 1E illustrates various features that may be interchangeable with elements of any other embodiment described in the specification.

In some embodiments, collapsible sole 10 comprises top sheet 12. Top sheet 12 extends essentially across entire surface area of collapsible sole 10. Top sheet 12 typically comprises a pliable or pliant polymeric material.

In some embodiments, collapsible sole 10 further comprises bottom sheet 14. Bottom sheet 14 extends essentially across entire surface area of collapsible sole 10. Bottom sheet 14 typically comprises a pliable or pliant polymeric material. In some embodiments, collapsible sole 10 further comprises plurality of lateral support elements 16. Support elements 16 extend in-between top sheet 12 and bottom sheet 14. In some embodiments, the plurality of lateral support elements 16 extend essentially along an entire width of collapsible sole 10. Support elements 16 typically comprise a pliable or pliant polymeric material.

In some embodiments, collapsible sole 10 further comprises a plurality of laterally extending channels 18. The plurality of laterally extending channels 18 are formed in-between lateral support elements 16 and in-between top sheet 12 and bottom sheet 14. In some embodiments, collapsible sole 10 further comprises plurality of top hinge elements 20. Top hinge elements 20 operationally connect top sheet 12 with the plurality of respective lateral support elements 16 of collapsible sole 10. In some embodiments, top hinge elements 20 are configured to sustain angular bending and/or partial rotation of respective lateral support elements 16 relative to top sheet 12. Top hinge elements 20 are typically manufactured by a polymeric welding and/or thermoplastic molding.

In some embodiments, collapsible sole 10 further comprises plurality of bottom hinge elements 22. Bottom hinge elements 22 operationally connect bottom sheet 14 with a plurality of respective lateral support elements 16 of collapsible sole 10. In some embodiments, bottom hinge elements 22 are configured to sustain angular bending and/or partial rotation of respective lateral support elements 16 relative to bottom sheet 14. Bottom hinge elements 22 are typically manufactured by a polymeric welding and/or thermoplastic molding.

In some embodiments, collapsible sole 10 further comprises at least one stopper element 24. At least one stopper element 24 typically comprises a rigid material. At least one stopper element 24 is disposable between top sheet 12 and bottom sheet 14. In some examples, at least one stopper element 24 embodies shape of rectangular profile. In some embodiments, at least one stopper element 24 embodies a shape congruent to at least one of laterally extending channel 18. In some embodiments, at least one stopper element 24 is insertable within at least one of laterally extending channel 18 and retrievable from at least one laterally extending channel 18.

Figure 1B:
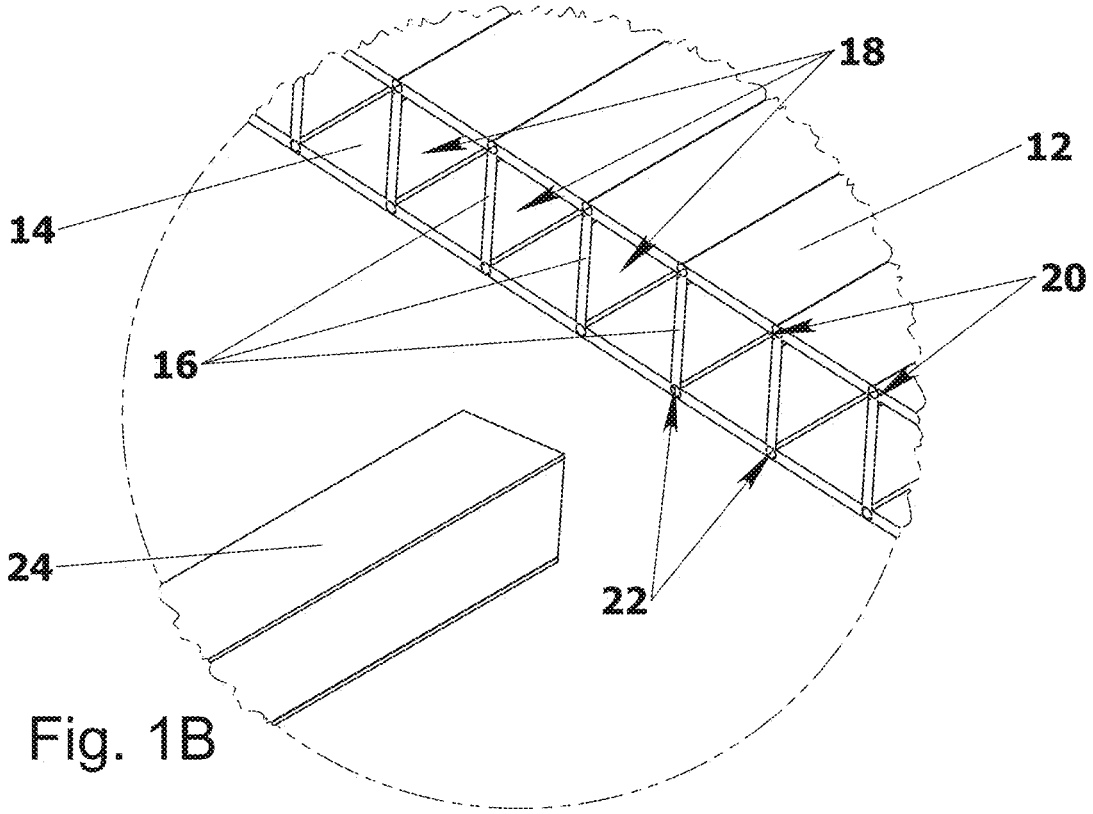
FIG. 1B is an enlarged perspective view of a collapsible sole of a collapsible footwear with at least one stopper element, according to an embodiment of the present invention.
Figure 1C:
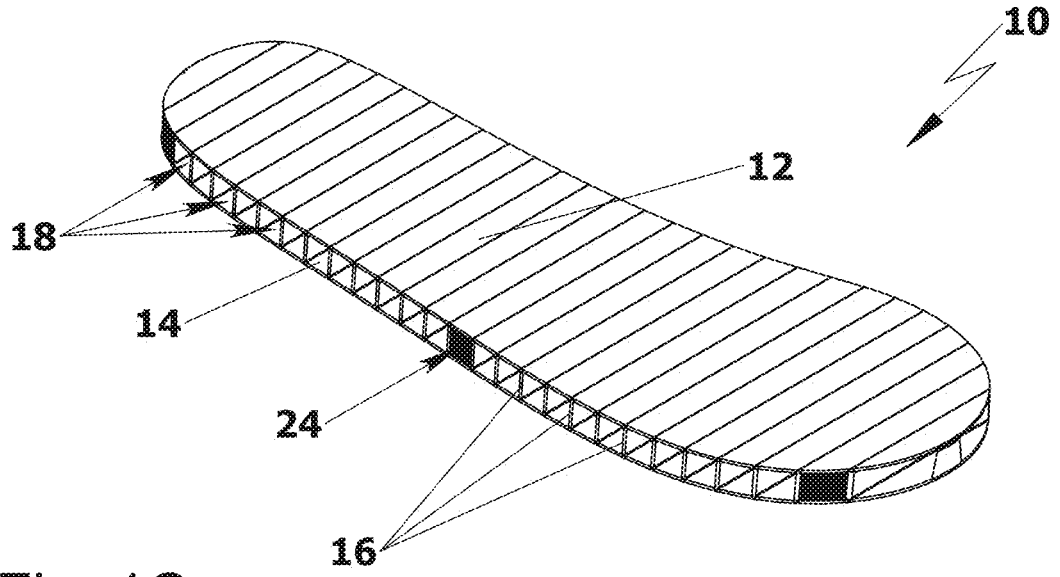
FIG. 1C is a perspective view of a collapsible sole in an erected configuration, according to an embodiment of the present invention.
Figure 1D:
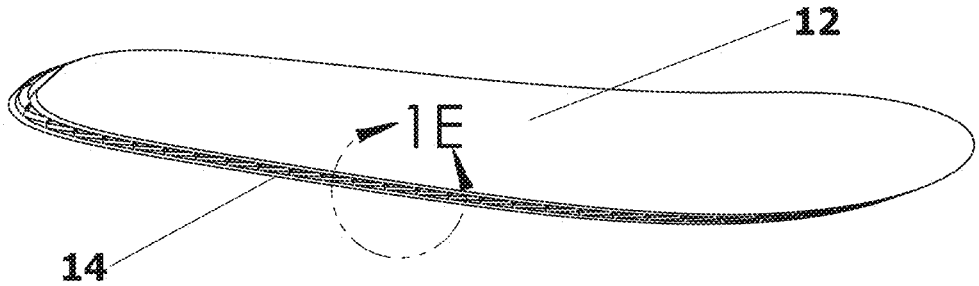
FIG. 1D is a perspective view of a collapsible sole in a collapsed configuration, according to an embodiment of the present invention.
Figure 1E:
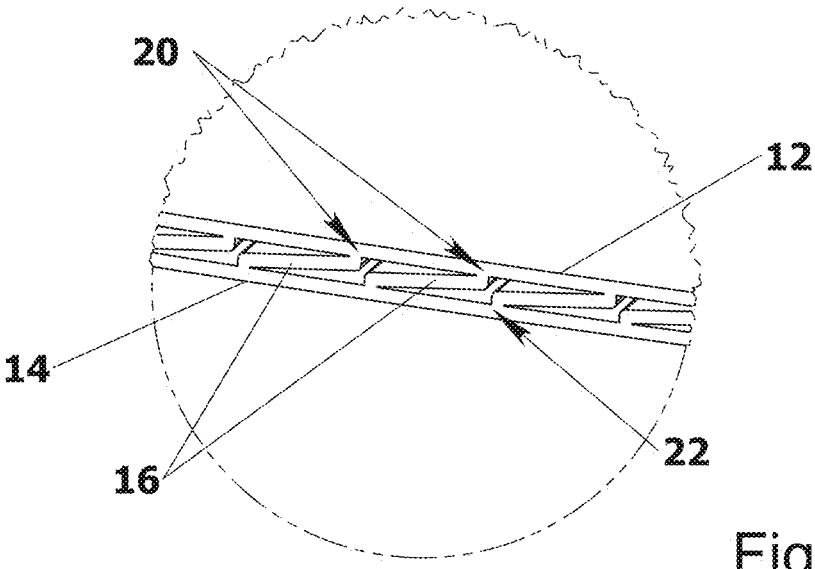
FIG. 1E is an enlarged perspective view of a collapsible sole in a collapsed configuration, according to an embodiment of the present invention.

In some embodiments, collapsible sole 10 is characterized by reversibly assuming a collapsed configuration shown in FIGS. 1D and 1E. Collapsible sole 10 is shown in FIGS. 1D and 1E in a collapsed configuration. In the collapsed configuration of FIGS. 1D and 1E, laterally extending channels 18 are essentially collapsed, thereby forming an acute angle between lateral support elements 16 and top sheet 12 and bottom sheet 14, thereby allowing top sheet 12 to be brought into the proximity relative to bottom sheet 14.

In some embodiments, collapsible sole 10 is characterized by reversibly assuming an erected configuration shown in FIG. 1A to 1C. Collapsible sole 10 is shown in FIG. 1A to 1C in an erected configuration. In some embodiments, in erected configuration, lateral support elements are disposed essentially perpendicularly to top sheet 12 and bottom sheet 14, thereby rendering the former spaced apart from the latter parallel. In some embodiments, in erected configuration, at least one stopper element 24 stabilizes laterally extending channels 18 in an open conformation, whilst top sheet 12 is spaced from bottom sheet 14.

In some embodiments, collapsible sole 10 further comprises at least one top part. An exemplary top part 210 is shown in FIG. 4C. In some examples, the top part is collapsible, whereas in other examples the top part is a modular and/or removable top part. In some embodiments, the top part further comprises a plurality of connecting elements. The connecting elements of the top part, such as connecting elements 212 of top part 210 is shown in FIG. 4C, are configured for readily connecting collapsible sole 10 with the top part. In some embodiments, collapsible sole 10 further comprises a plurality of connecting elements. The connecting elements, such as connecting elements 214 of collapsible sole 200 is shown in FIG. 4C, are configured for readily connecting collapsible sole 10 with least the top part.

In some embodiments, in the collapsed configuration, plurality of laterally extending channels 18 of collapsible sole 10 are collapsed along a vertical axis and across a vertical plane of collapsible sole 10. In some embodiments, in the collapsed configuration, collapsible sole 10 maintains an essentially planar shape and substantially constant lengths along the longitudinal axis and across a horizontal plane of collapsible sole 10, perpendicular to the vertical plane. In some embodiments, the in collapsed configuration collapsible sole 10 maintains an essentially constant width along the transversal axis and across a horizontal plane of collapsible sole 10, perpendicular to the vertical plane.

In accordance with some preferred embodiments of the present invention, reference is now made to FIG. 2A to 2F, showing another embodiment of collapsible sole 50. The collapsible sole of the embodiment of FIG. 2A to 2F illustrates various features that may be interchangeable with elements of any other embodiment described in the specification. In some embodiments, collapsible sole 50 comprises top sheet 52. Top sheet 52 extends essentially across entire surface area of collapsible sole 50. Top sheet 52 typically comprises a pliable or pliant polymeric material. In some embodiments, top sheet 52 comprises frontal portion 52A and rear portion 52B. In some embodiments, collapsible sole 50 further comprises bottom sheet 54. Bottom sheet 54 extends essentially across the entire surface area of collapsible sole 50. In some embodiments, bottom sheet 54 comprises frontal portion 54A and rear portion 54B.

In some embodiments, collapsible sole 50 further comprises a plurality of lateral support elements 56. In some embodiments, lateral support elements 56 extend in-between top sheet 52 and bottom sheet 54. In some embodiments, lateral support elements 56 extend essentially along an entire width of collapsible sole 50. Support elements 56 typically comprise a pliable or pliant polymeric material.

In some embodiments, collapsible sole 50 further comprises plurality of laterally extending channels 58. Laterally extending channels 58 are formed in-between lateral support elements 56 and in-between top sheet 52 and bottom sheet 54.

In some embodiments, collapsible sole 50 further comprises plurality of top hinge elements 60. Top hinge elements 60 operationally connecting top sheet 52 with the respective lateral support elements 56 of collapsible sole 50. Top hinge elements 60 are typically manufactured by a polymeric welding and/or thermoplastic molding. In some embodiments, top hinge elements 60 are configured to sustain angular bending and/or partial rotation of respective lateral support elements 56 relative to top sheet 52.

In some embodiments, collapsible sole 50 further comprises plurality of bottom hinge elements 62. Plurality of bottom hinge elements 62 operationally connecting bottom sheet 54 and plurality of lateral support elements 56 of collapsible sole 50. In some embodiments, plurality of bottom hinge elements 62 are configured to sustain angular bending and/or partial rotation of respective lateral support elements 56 relative to bottom sheet 54. Bottom hinge elements 62 are typically manufactured by a polymeric welding and/or thermoplastic molding.

In some embodiments, collapsible sole 50 further comprises at least one stopper element 64. At least one stopper element 64 typically comprises a rigid material. At least one stopper element 64 is disposable between top sheet 52 and bottom sheet 54. In some examples, at least one stopper element 64 embodies an elongated trapezoid shape. In some embodiments, collapsible sole 50 further comprises centrical portion 68. In some embodiments, at least one stopper element 64 at centrical portion 68 of collapsible sole 50.

Figure 2A:
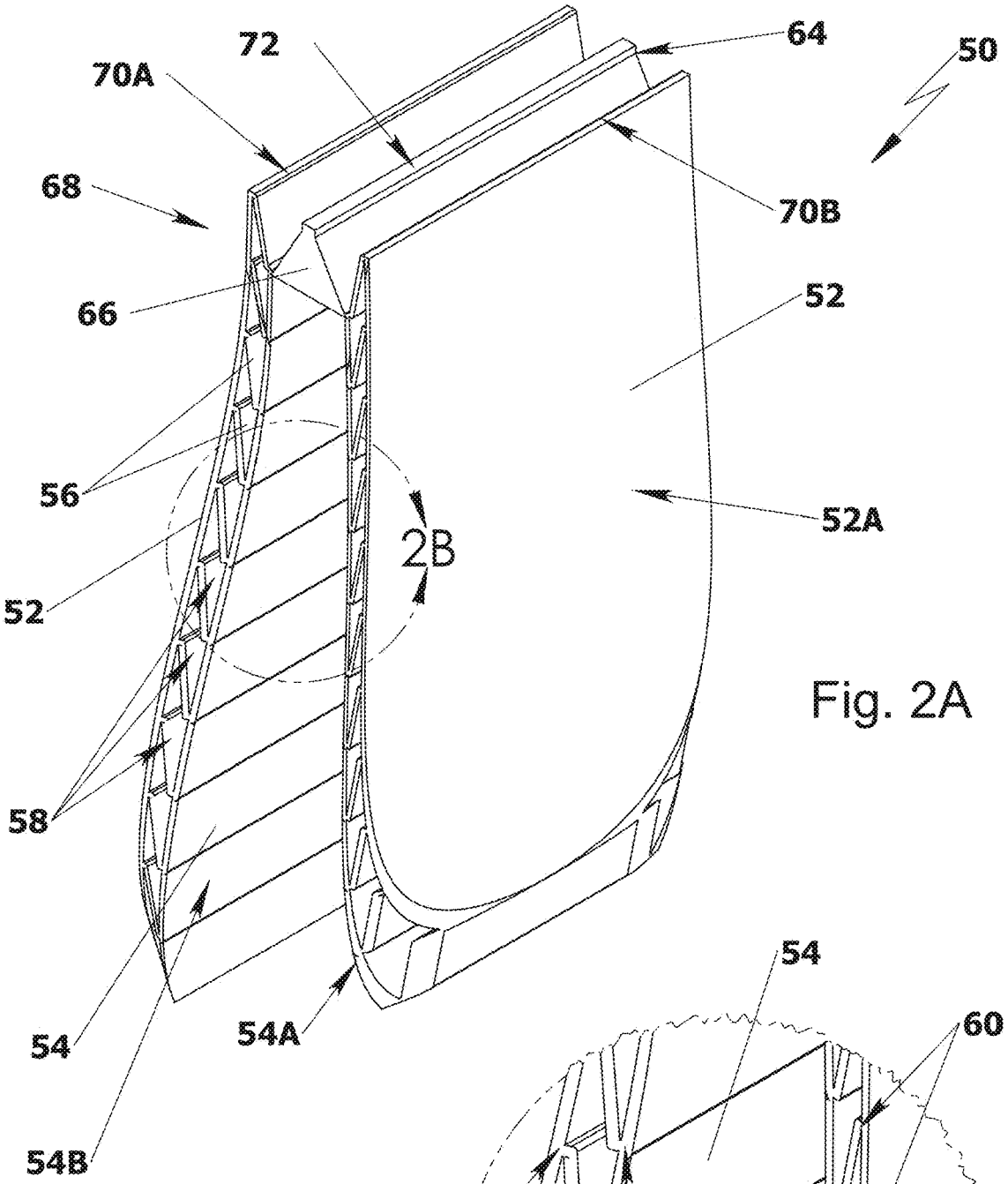
FIG. 2A is a perspective view of a collapsible sole in collapsed and folded configurations, according to some embodiment of the present invention.
Figure 2B:
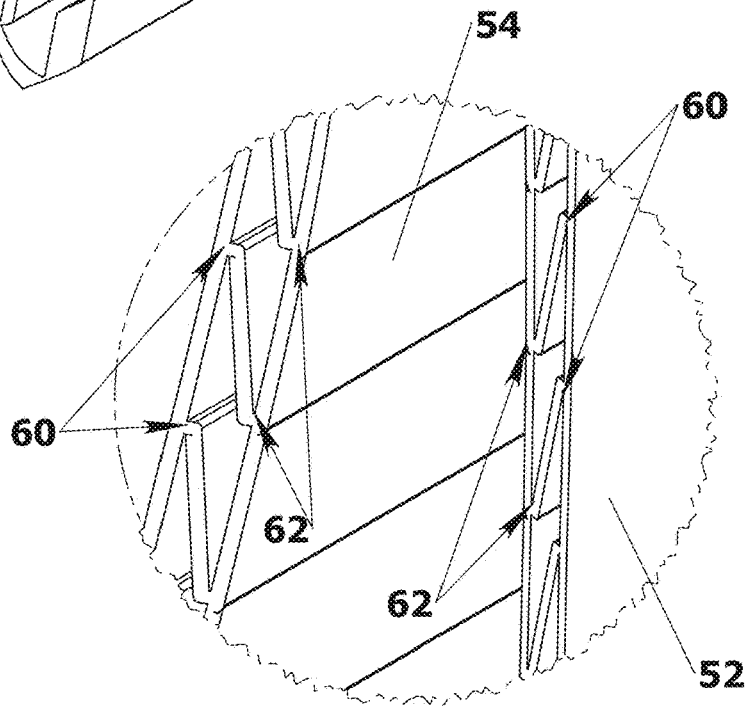
FIG. 2B is an enlarged perspective view of a collapsible sole in collapsed and folded configurations, according to some embodiment of the present invention.
Figure 2C:
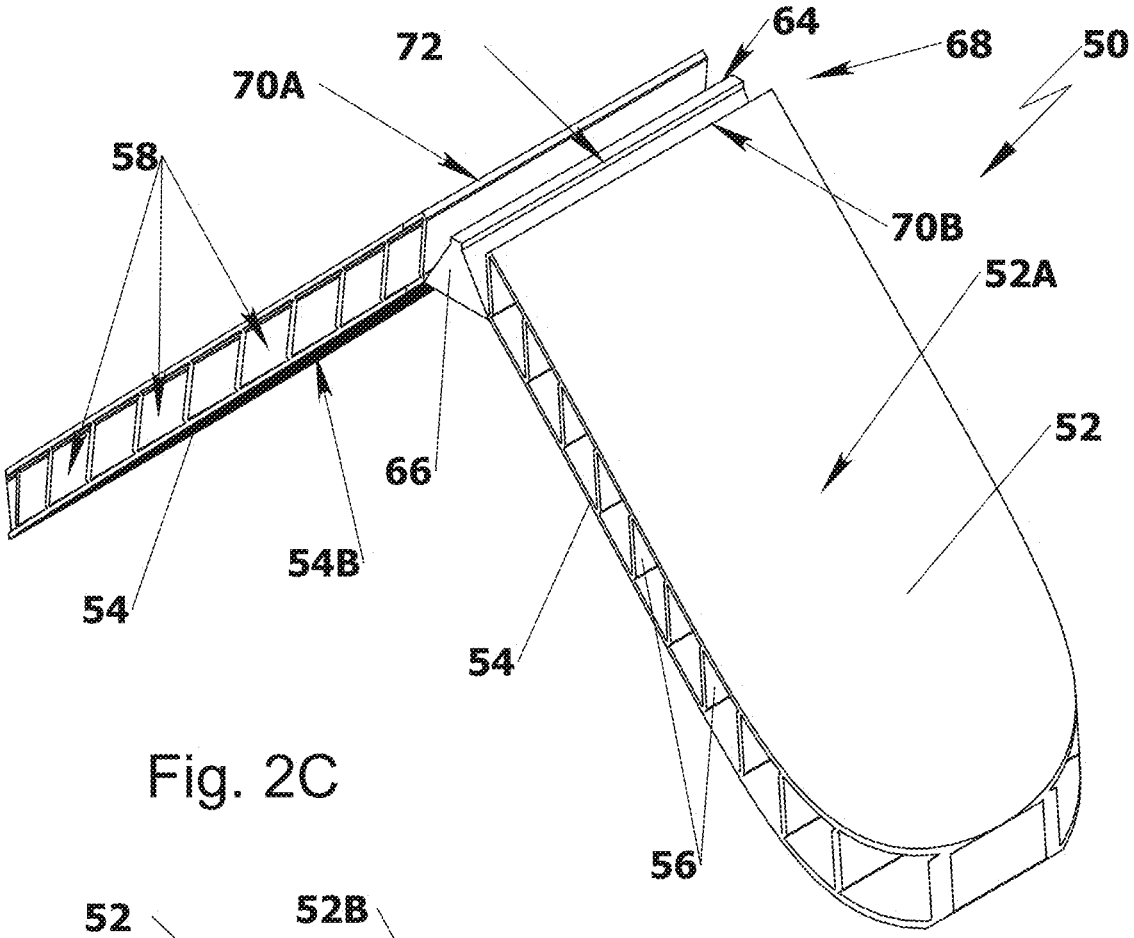
FIG. 2C is a perspective view of a collapsible sole in a partially collapsed configuration, according to some embodiment of the present invention.
Figure 2D:
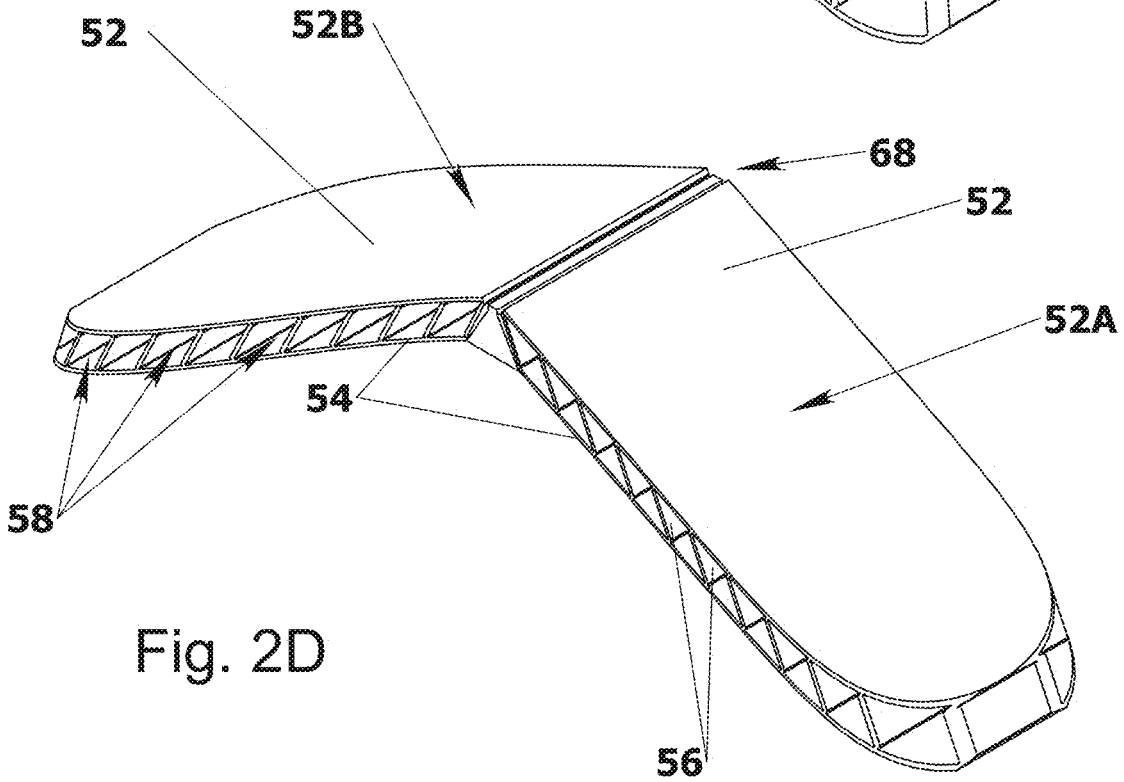
FIG. 2D is a perspective view of a collapsible sole in a partially collapsed configuration, according to some embodiment of the present invention.
Figure 2E:
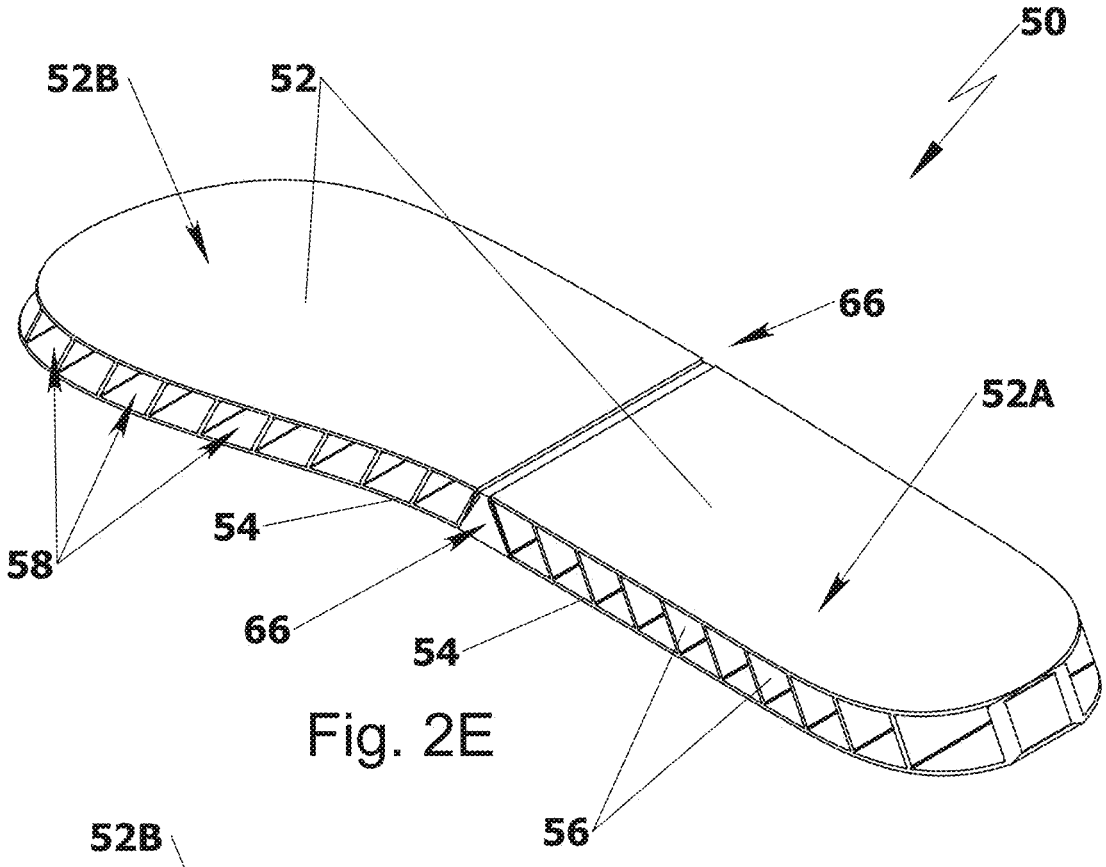
FIG. 2E is a perspective view of a collapsible sole in a partially erected configuration, according to some embodiment of the present invention.
Figure 2F:
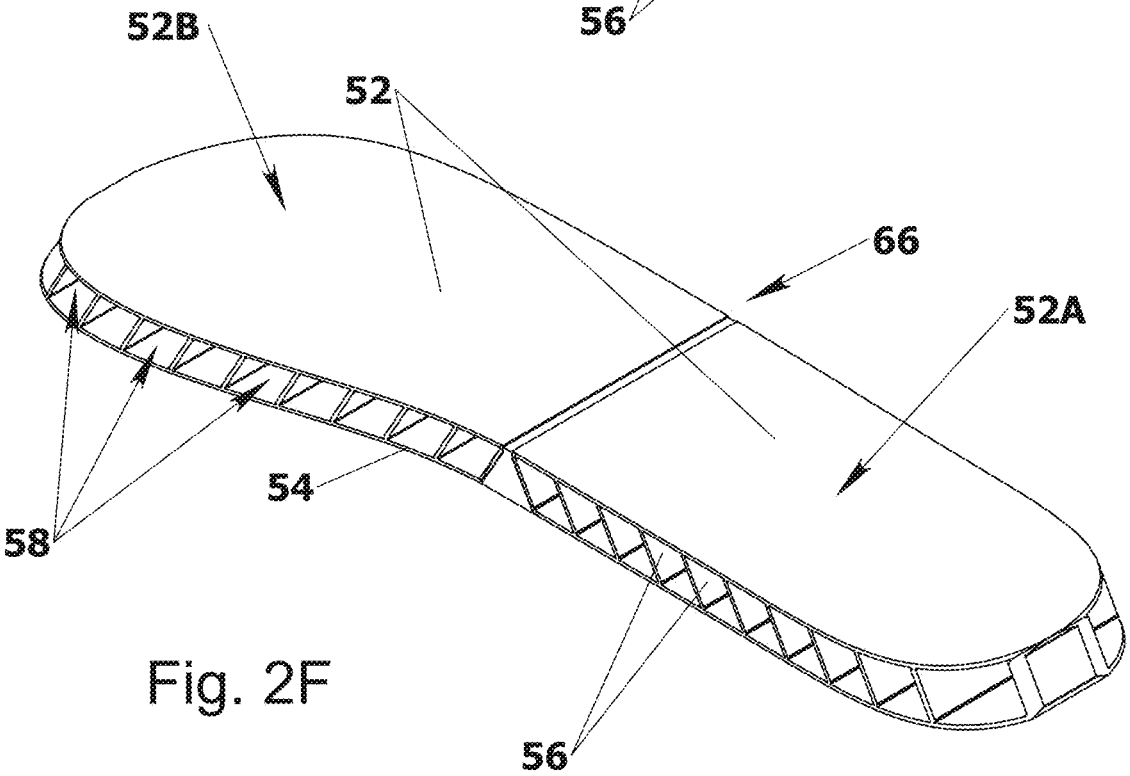
FIG. 2F is a perspective view of a collapsible sole in an erected configuration, according to some other embodiment of the present invention.

In some embodiments, collapsible sole 50 is characterized by reversibly assuming a collapsed configuration, shown in FIGS. 2A and 2B, as well as an erected configuration, shown in FIG. 2F. In some embodiments, collapsible sole 50 assumes a collapsed configuration, shown in FIGS. 2A and 2B, in which laterally extending channels 58 are essentially collapsed, thereby forming an acute angle between plurality of lateral support elements 56 and top sheet 52 and bottom sheet 54, as well as bringing top sheet 52 into proximity with bottom sheet 54.

In some embodiments, collapsible sole 50 assumes an erected configuration, shown in FIG. 2F. In some embodiments, at least one stopper element 64 stabilizes laterally extending channels 58 in an open conformation, whereas top sheet 52 is spaced from bottom sheet 54.

In some embodiments, collapsible sole 50 further comprises at least one top pat. In some examples, the top part is a collapsible top part whereas in other examples the top part is a removable top part. In some embodiments, the top part further comprises a plurality of connecting elements. The connecting elements are configured for readily connecting collapsible sole 50 with the top part.

In some embodiments, centrical portion 68 of collapsible sole 50 accommodates a mechanism rendering collapsible sole 50 configured to further assume a folded configuration and an unfolded configuration. In some embodiments, in a folded configuration, bottom sheet 54 of collapsible sole 50 is folded about centrical portion 68, so that frontal portion 54A of bottom sheet 54 is disposed adjacently to rear portion 54B of bottom sheet 54. In some embodiments, in a folded configuration, posterior top hinge elements 70A and 70B are spaced apart from top portion 72 of trapezoid shape 66.

In some embodiments, in an unfolded configuration, bottom sheet 54 of collapsible sole 50 is straightened into an essentially planar shape, so that frontal portion 54A of bottom sheet 54 forms an approximately straight angle relative to rear portion 54B of bottom sheet 54. In some embodiments, in a folded configuration, posterior top hinge elements 70A and 70B are adjoined to top portion 72 of trapezoid shape 66, of stopper element 64.

In some embodiments, in the collapsed configuration, plurality of laterally extending channels 58 of collapsible sole 50 are collapsed along a vertical axis and across a vertical plane of collapsible sole 50. In some embodiments, in the collapsed configuration, collapsible sole 50 maintains an essentially planar shape and substantially constant lengths along the longitudinal axis and across a horizontal plane of collapsible sole 50, perpendicular to the vertical plane. In some embodiments, the in collapsed configuration collapsible sole 50 maintains an essentially constant width along the transversal axis and across a horizontal plane of collapsible sole 50, perpendicular to the vertical plane.

In accordance with some preferred embodiments of the present invention, reference is now made to FIG. 3A to 3F showing another embodiment of collapsible sole 100. The collapsible sole of the embodiment of FIG. 3A to 3F illustrates various features that may be interchangeable with elements of any other embodiment described in the specification.

In some embodiments, collapsible sole 100 comprises top sheet 102. Top sheet 102 extends essentially across entire surface area of collapsible sole 100. In some embodiments, collapsible sole 100 further comprises bottom sheet 104. Bottom sheet 104 extends essentially across entire surface area of collapsible sole 100. Top sheet 102 and bottom sheet 104 typically comprise a pliable or pliant polymeric material.

In some embodiments, collapsible sole 100 further comprises a plurality of lateral support elements 106. Lateral support elements 106 extend between top sheet 102 and bottom sheet 104. In some embodiments, Lateral support elements 106 extend essentially along an entire width of collapsible sole 100.

In some embodiments, collapsible sole 100 further comprises a plurality of laterally extending channels 108. Laterally extending channels 108 are formed in-between lateral support elements 106 and in-between top sheet 102 and bottom sheet 104.

In some embodiments, collapsible sole 100 further comprises a plurality of top hinge elements 110. Top hinge elements 110 operationally connect top sheet 102 to respective lateral support elements 106 of collapsible sole 100. In some embodiments, plurality of top hinge elements 110 are configured to sustain angular bending and/or partial rotation of respective lateral support elements 106 relative to top sheet 102.

In some embodiments, collapsible sole 100 further comprises a plurality of bottom hinge elements 112. Plurality of bottom hinge elements 112 operationally connect bottom sheet 104 to respective lateral support elements 106 of collapsible sole 100. In some embodiments, bottom hinge elements 112 are configured to sustain angular bending and/or partial rotation of respective lateral support elements 106 relative to bottom sheet 104.

In some embodiments, collapsible sole 100 further comprises at least one stopper element 114. At least one stopper element 114 is disposable between top sheet 102 and bottom sheet 114. At least one stopper element 114 comprises an essentially linear shape 66. In some preferred embodiments, each one of laterally extending channels 108 accommodates an individual stopper element 114. In some preferred embodiments, each one stopper elements 114 extend along an entire width of collapsible sole 100. In some preferred embodiments, some stopper elements 114 comprise top stopper hinge portion 116 forming a connection with top sheet 112 of collapsible sole 100, whereas other stopper elements 114 comprise bottom stopper hinge portion 118 forming a connection with bottom sheet 114. In some embodiments, stopper elements 114 are accommodated with laterally extending channels 108 and connected to top sheet 102 of collapsible sheet 100 by top stopper hinge portions 116. In some embodiments, stopper element 114 are accommodated within other laterally extending channels 108 and connected to bottom sheet 104 of collapsible sheet 100 by bottom stopper hinge portions 118.

In some embodiments, collapsible sole 100 comprises a composite material and/or structure, in which top sheet 102 and bottom sheet 104 comprise a pliant and/or flexible material, such as synthetic woven fabric, whereas lateral support elements 106 and/or stopper elements 114 comprise firm and/or rigid material, such as rigid polymeric plates and/or segments, which are enclosed within and/or fused with a pliant and/or flexible material, such as synthetic woven fabric, thereby conferring exceptional foldability to top hinge elements 110 and bottom hinge elements 112, whilst concomitantly conferring superb firmness to lateral support elements 106 and/or stopper elements 114.

In some embodiments, collapsible sole 100 comprises an assembly and/or construct of pars, in which top sheet 102 and bottom sheet 104 comprise a pliant and/or flexible material, such as synthetic woven fabric, whereas additionally corresponding pouches are formed from a pliant and/or flexible material, such as synthetic woven fabric for lateral support elements 106 and/or stopper elements 114. In such embodiments, lateral support elements 106 and/or stopper elements 114 comprise firm and/or rigid material, such as, rigid polymeric and/or even metallic plates, which are insertable into and or retrievable from within the aforementioned corresponding pouches that are formed from a pliant and/or flexible material, thereby conferring exceptional foldability to top hinge elements 110 and bottom hinge elements 112, whilst concomitantly conferring superb firmness to lateral support elements 106 and/or stopper elements 114.

It should be acknowledged that the implementation of the novel and innovative shape and/or composite material and/or structure and/or assembly and/or construct of pars, of collapsible sole 100, as well as the implementations of the shape and/or composite material and/or structure and/or assembly and/or construct of pars of any other collapsible sole described in this specification hereinabove and/or hereunder, as a collapsible sole for collapsible footwear is merely exemplary and is not limited to collapsible soles or collapsible footwear. Whereas, the implementation of the novel and innovative shape and/or composite material and/or structure and/or assembly and/or construct of pars, of collapsible sole 100, as well as the implementations of the shape and/or composite material and/or structure and/or assembly and/or construct of pars of any other collapsible sole described in this specification hereinabove and/or hereunder, equally include numerous implementations embodying various other products, such as collapsible sheeting of indefinite lengths and/or widths and/or surface area and/or height and/or thickness, which are expediently applicable and implementable in a vast variety of products, in a non-limiting manner including: collapsible matting, collapsible rugs, collapsible carpet, collapsible thermally insulating sheeting or any product for that matter.

In some embodiments, collapsible sole 100 is characterized by reversibly assuming a collapsed configuration and an erected configuration. In some embodiments, in a collapsed configuration, shown in FIGS. 3E and 3F, lateral support elements 106 form an approximately straight angle with adjacent lateral support elements 106. In some embodiments, in an erected configuration, stopper elements 114 connected to top sheet 102 are driven downwardly and/or brought to bottom sheet 104. In some embodiments, in an erected configuration, stopper elements 114 connected to bottom sheet 104 are driven upwardly and/or brought to top sheet 102. to be spaced from bottom sheet 104.

Figure 3A:
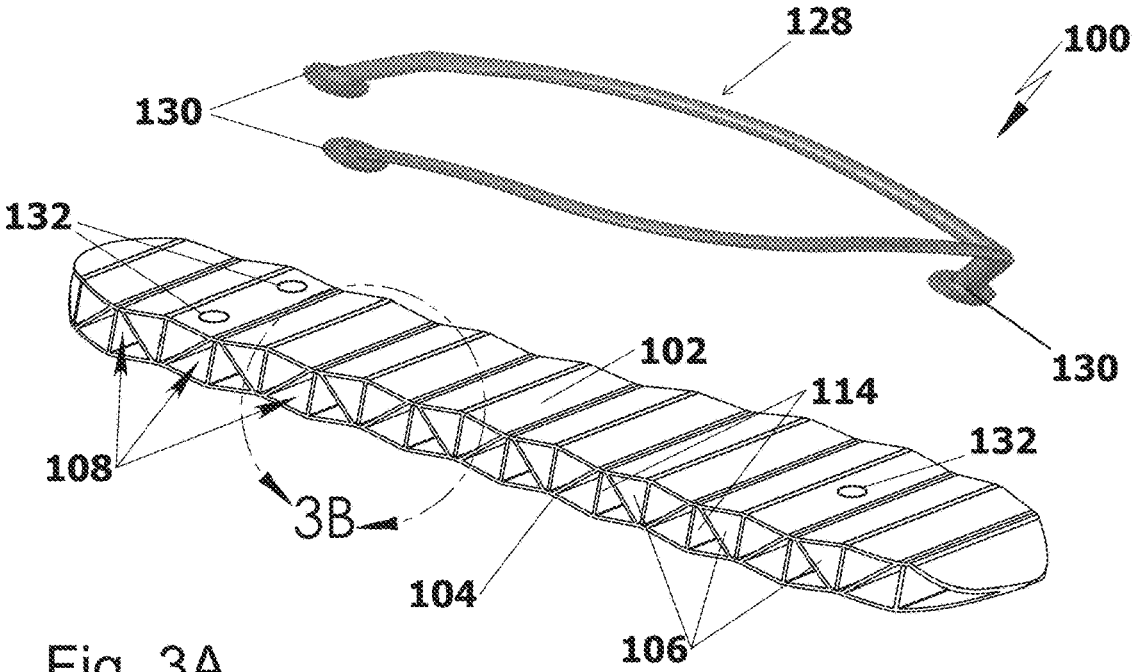
FIG. 3A is a perspective view of a collapsible sole in an erected configuration and a top part, according to some embodiment of the present invention.
Figure 3B:
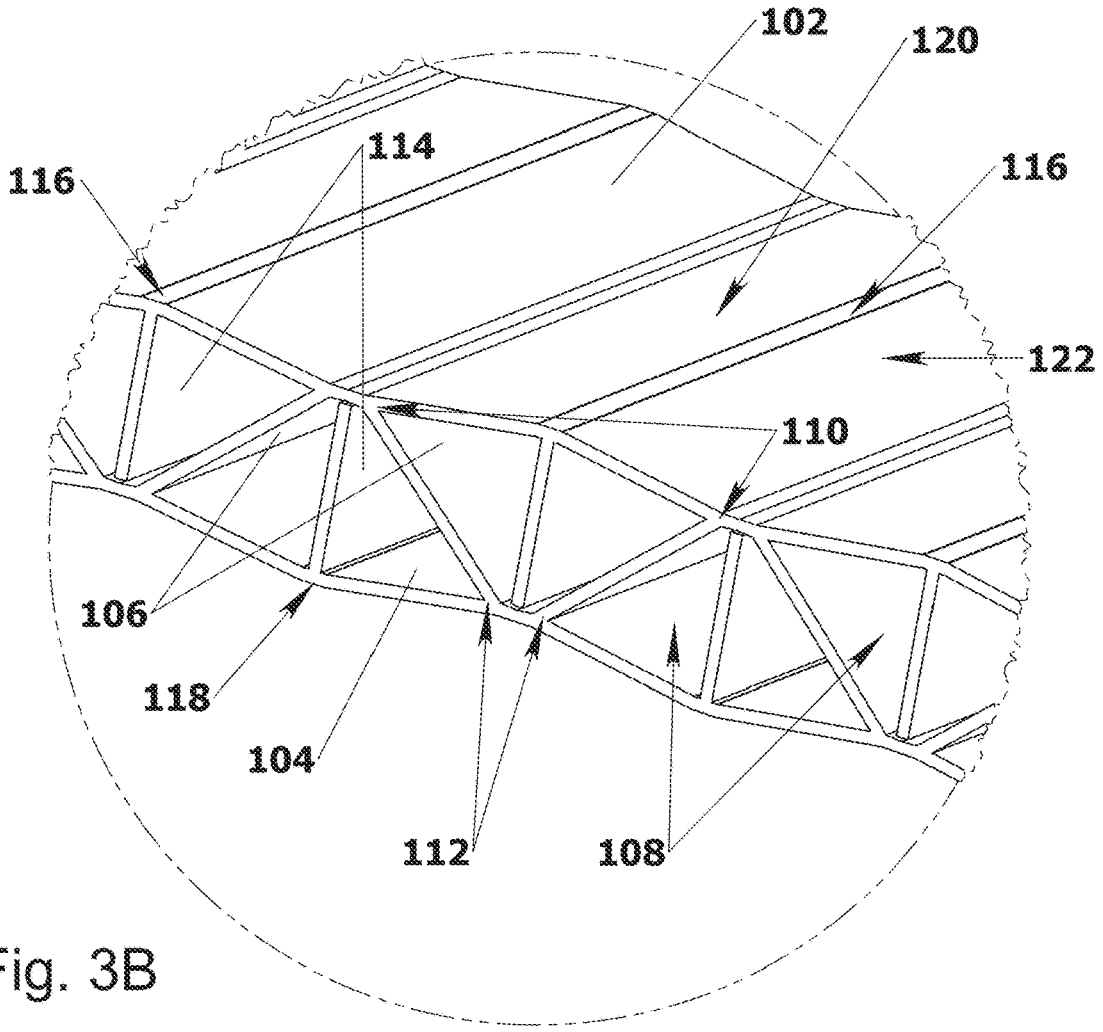
FIG. 3B is an enlarged perspective view of a collapsible sole in an erected configuration, according to some embodiment of the present invention.
Figure 3C:
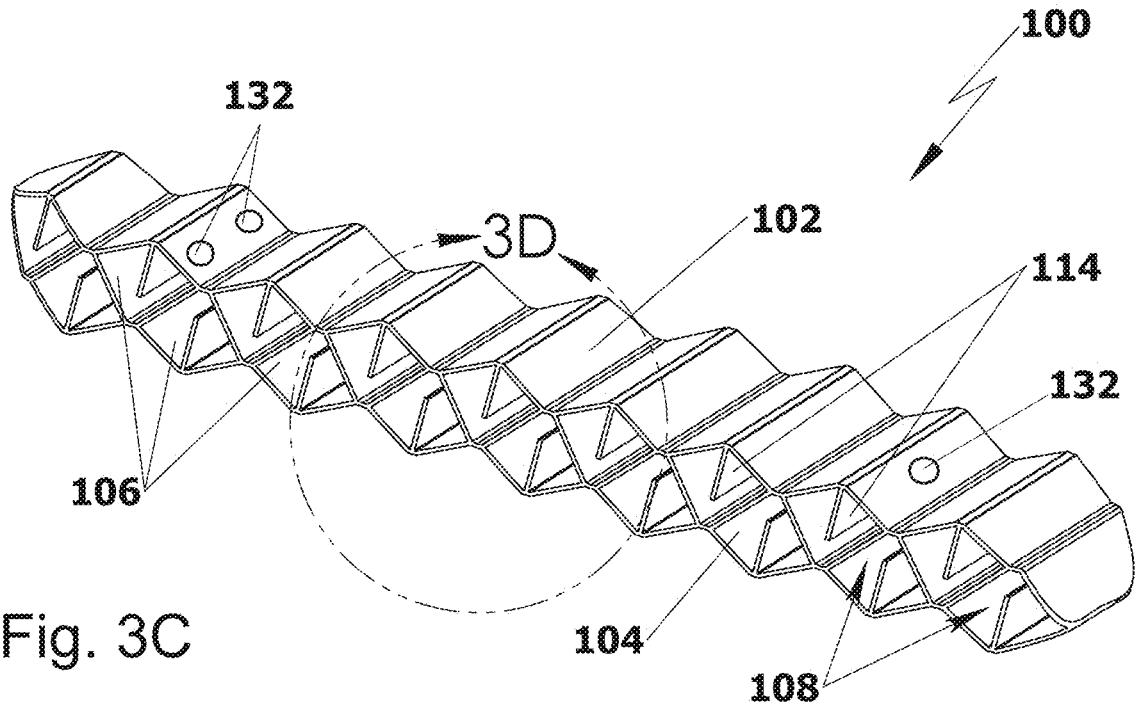
FIG. 3C is a perspective view of a collapsible sole in a partially collapsed configuration, according to some embodiment of the present invention.
Figure 3D:
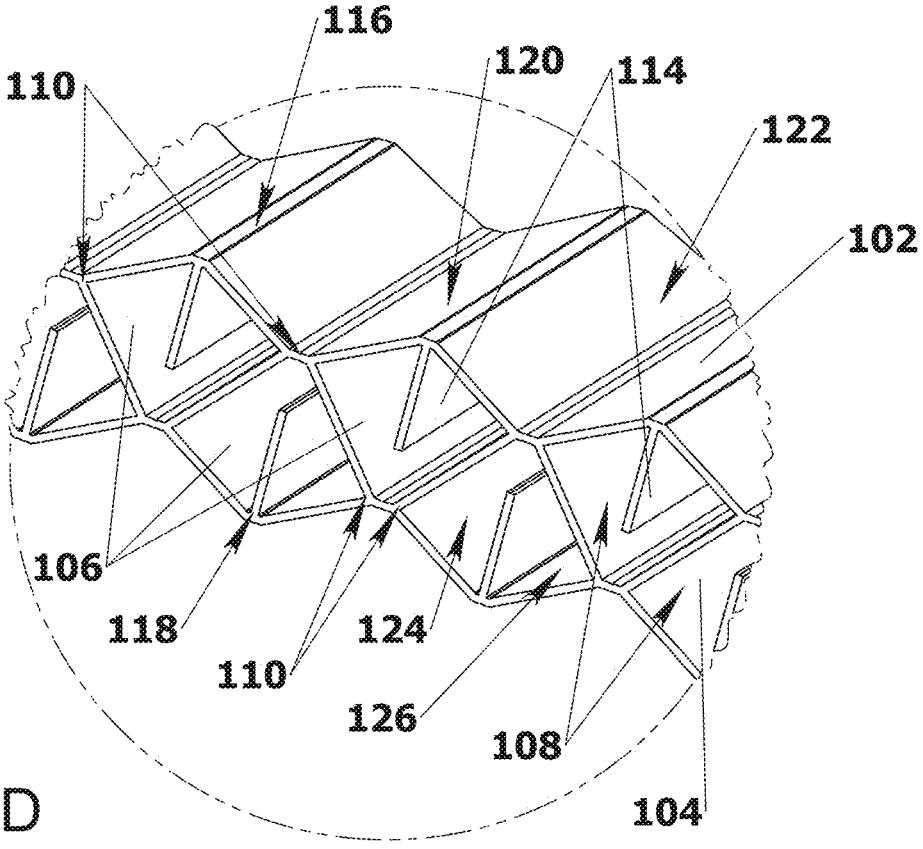
FIG. 3D is an enlarged perspective view of a collapsible sole in a partially collapsed configuration, according to some embodiment of the present invention.
Figure 3E:
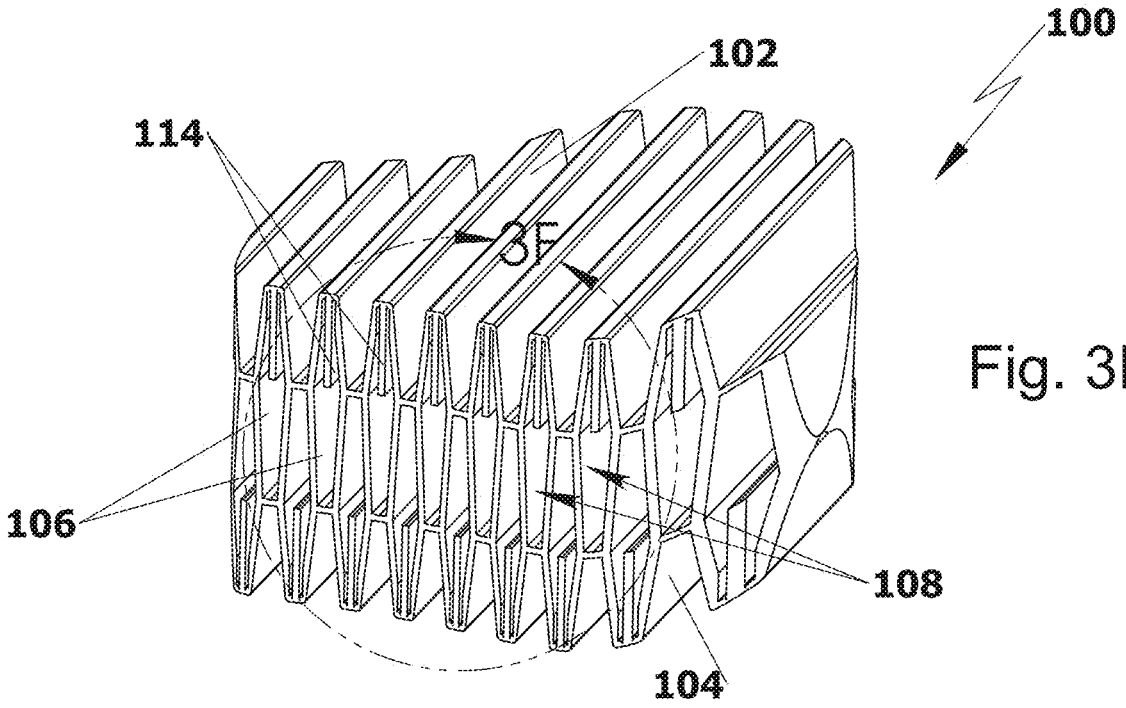
FIG. 3E is a perspective view of a collapsible sole in a completely collapsed configuration, according to some embodiment of the present invention.
Figure 3F:
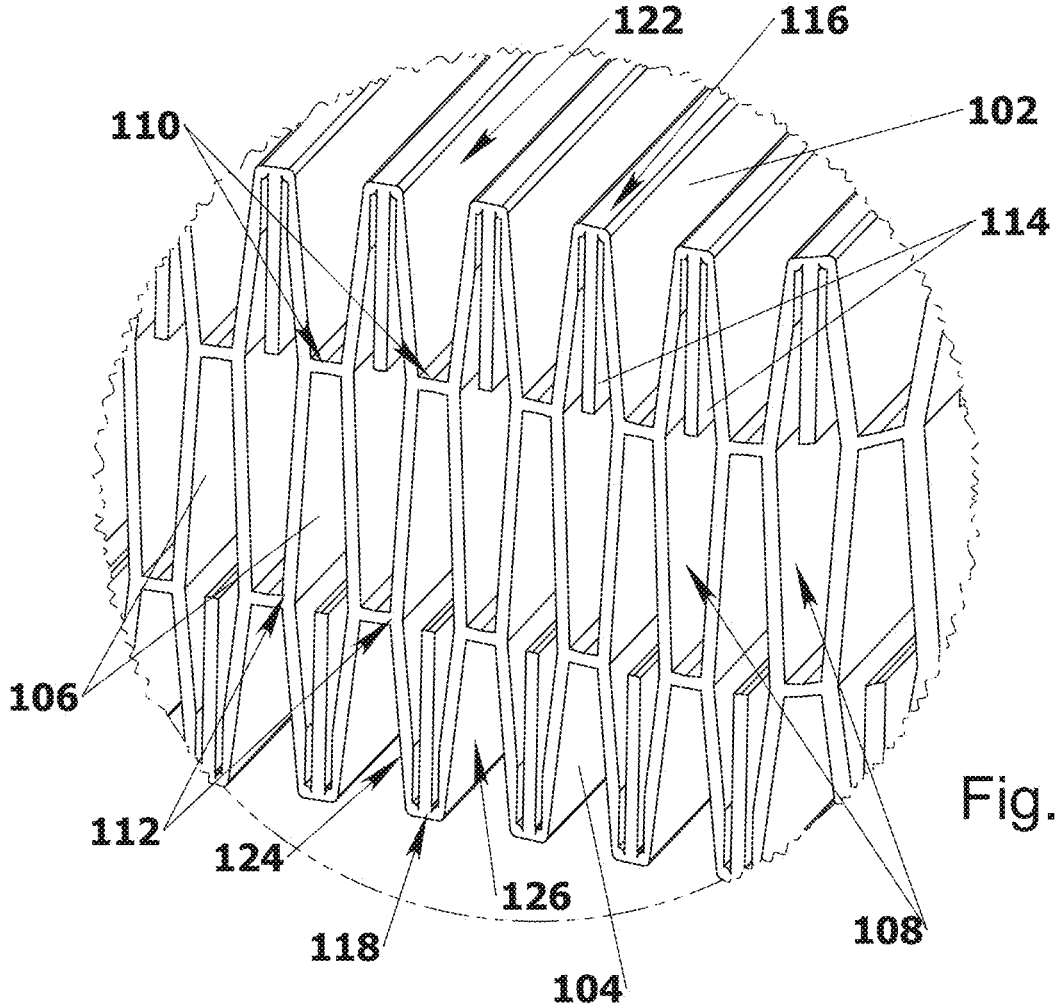
FIG. 3F is an enlarged perspective view of a collapsible sole in a completely collapsed configuration, according to some embodiment of the present invention.

In some embodiments, in a collapsed configuration, shown in FIGS. 3E and 3F, top sheet 102 of collapsible sole 100 assumes a corrugated shape. In some embodiments, in a collapsed configuration, top sheet 102 is folded about top stopper hinge portions 116, forming an approximately acute angle first portions 120 of top sheet 102 and second portions 122 of top sheet 102. In some embodiments, in a collapsed configuration, top sheet 102 is folded about top stopper hinge portions 116, so that first portions 120 of top sheet 102 and second portions 122 of top sheet 102 are disposed essentially adjointly to stopper elements 114. In some embodiments, in a collapsed configuration, first portions 120 of top sheet 102 and second portions 122 of top sheet 102 are folded about top stopper hinge portions 116, so that first portions 120 and second portions 122 of top sheet 102 form an approximately acute angle relative to stopper elements 114.

In some embodiments, in a collapsed configuration, bottom sheet 104 of collapsible sole 100 assumes a corrugated shape. In some embodiments, in a collapsed configuration, bottom sheet 104 is folded about bottom stopper hinge portions 118, forming an approximately acute angle first portions 124 of bottom sheet 102 and second portions 126 of bottom sheet 104. In some embodiments, in a collapsed configuration, bottom sheet 104 is folded about bottom stopper hinge portions 118, so that first portions 124 of bottom sheet 104 and second portions 126 of bottom sheet 104 are disposed essentially adjointly to stopper elements 114. In some embodiments, in a collapsed configuration, first portions 124 of bottom sheet 104 and second portions 126 of bottom sheet 104 are folded about bottom stopper hinge portions 118, so that first portions 124 and second portions 126 of bottom sheet 104 form an approximately acute angle relative to stopper elements 114.

In some embodiments, collapsible sole 100 assumes an erected configuration. In an erected configuration, shown in FIGS. 3A and 3B, at least one stopper element 114 stabilizes laterally extending channels 108 in an open conformation. In an erected configuration, shown in FIGS. 3A and 3B, top sheet 52 and bottom sheet 104 assume a straight and/or planar form.

In some embodiments, collapsible sole 100 further comprises at least one top pat 128. In some examples, at least one top part 128 is a collapsible top part and/or a removable top part. In some embodiments, top part 128 further comprises plurality of connecting elements 130. Connecting elements 130 are configured for readily connecting collapsible sole 100 with top part 128 and readily disconnecting collapsible sole 100 from top part 128. Each of connecting elements 130 of top part 128 is connectable to a corresponding connecting element, such as securing aperture 132, of collapsible sole 100, thereby securing top part 128 with collapsible sole 100.

In some embodiments, in the collapsed configuration, plurality of laterally extending channels 108 of collapsible sole 100 are collapsed along a longitudinal axis and across a horizontal plane of collapsible sole 100. In some embodiments, in the collapsed configuration, plurality of laterally extending channels 108 of collapsible sole 100 are collapsed along a vertical axis and across a vertical plane of collapsible sole 100. In some embodiments, in the collapsed configuration, collapsible sole 100 assumes an essentially corrugated shape and maintains substantially constant width along the transversal axis of the horizontal plane of collapsible sole 10.

Figure 4A:
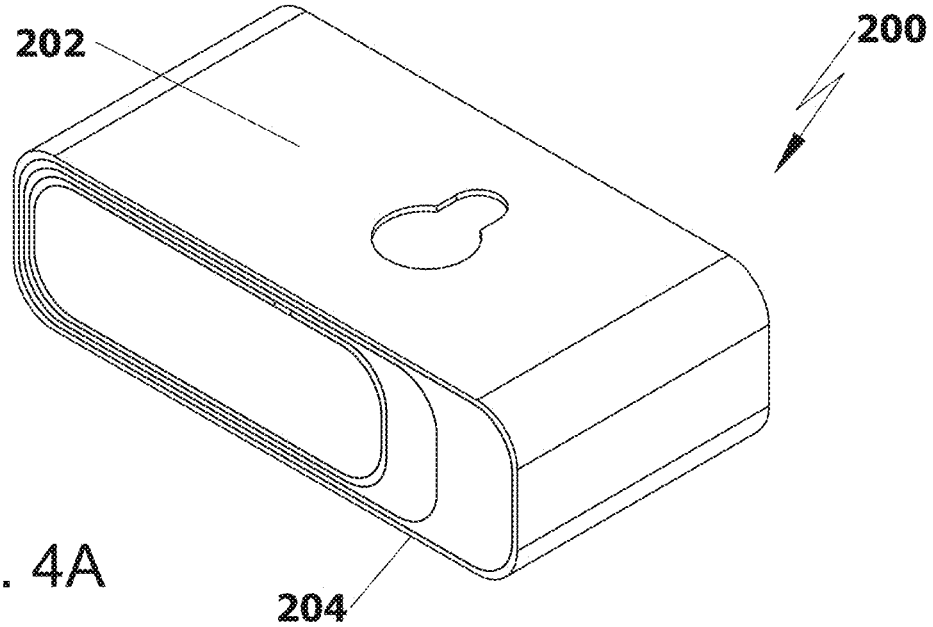
FIG. 4A is a perspective view of a collapsible sole in a completely collapsed configuration, according to some embodiment of the present invention.
Figure 4B:
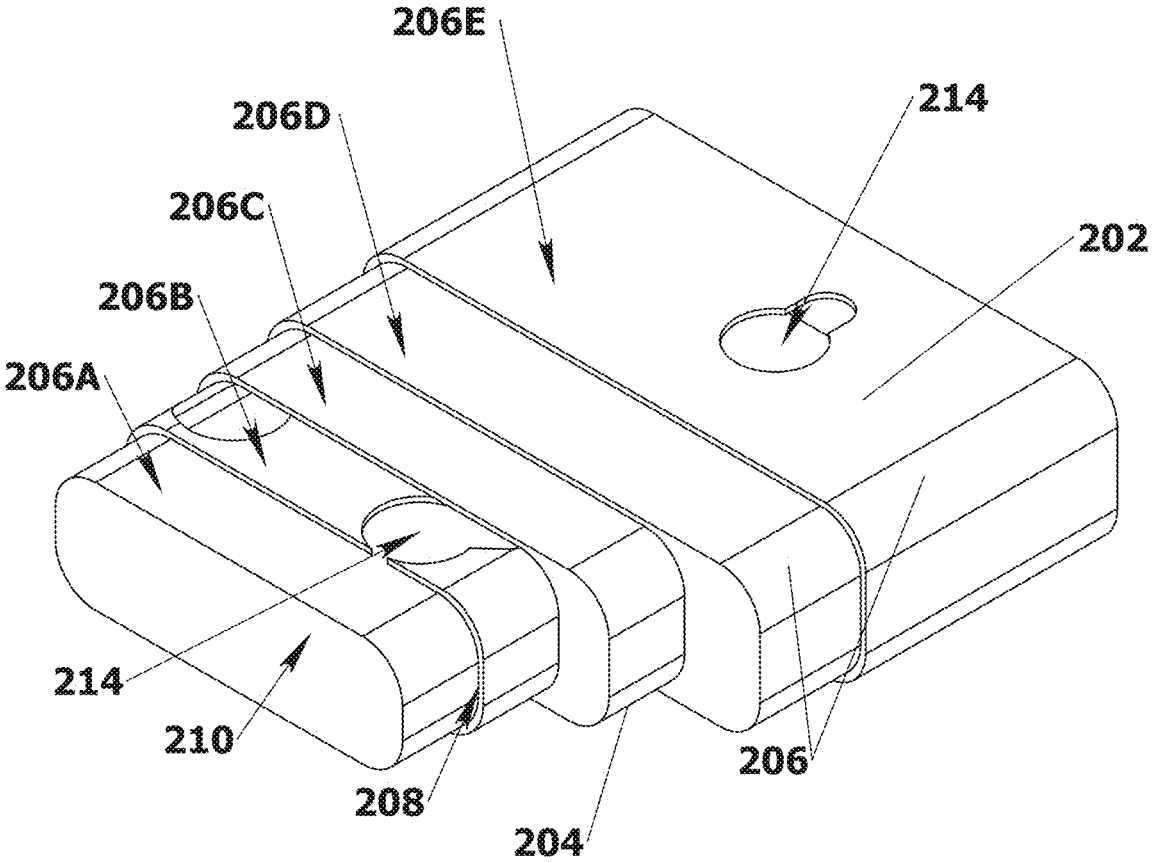
FIG. 4B is a perspective view of a collapsible sole in a partially collapsed configuration, according to some embodiment of the present invention.
Figure 4C:
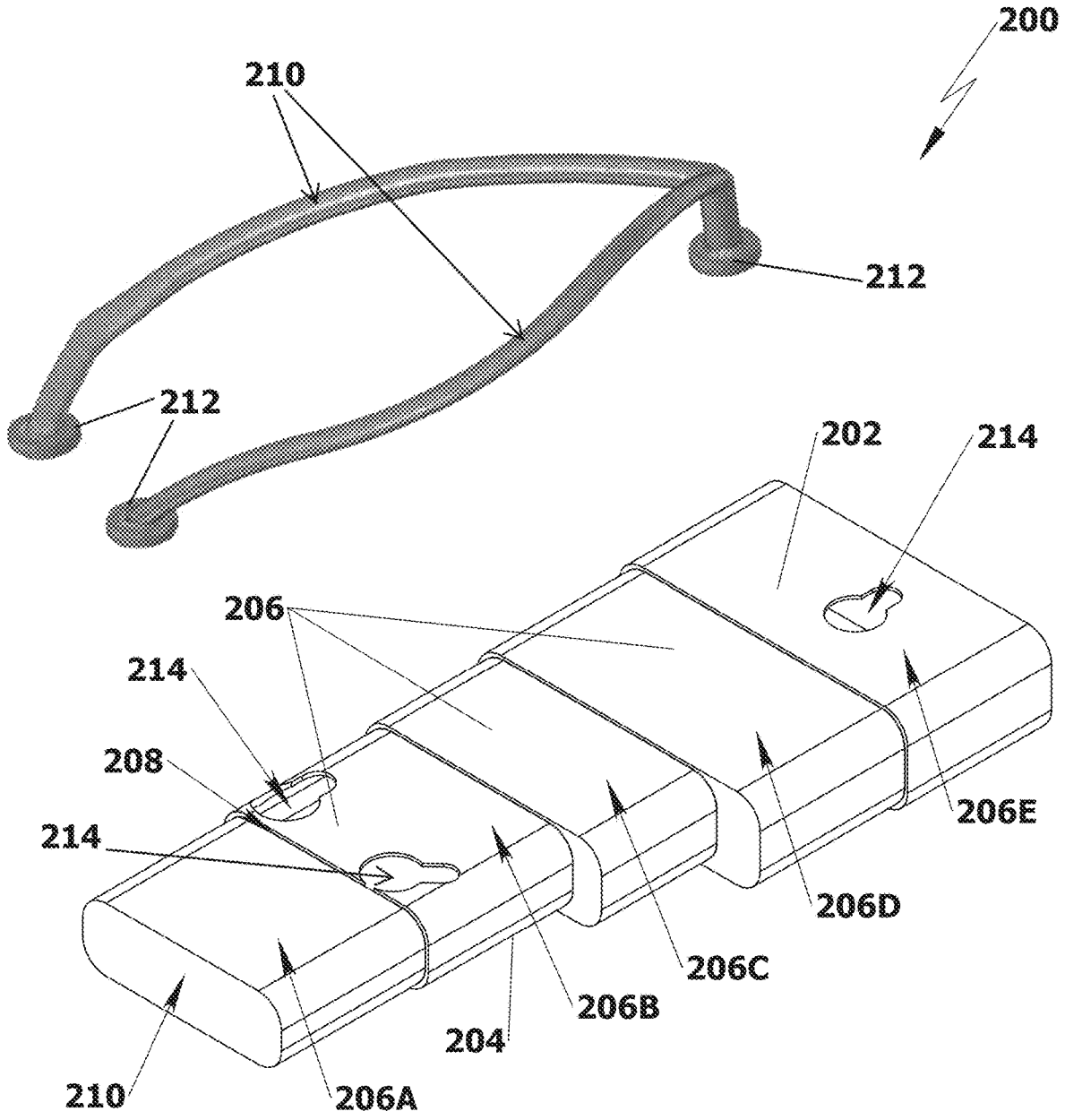
FIG. 4C is a perspective view of a collapsible sole in an erected configuration and a top part, according to some embodiment of the present invention.

In accordance with some preferred embodiments of the present invention, reference is now to FIG. 4A to 4C showing yet another embodiment of collapsible sole 200 of a collapsible footwear. The collapsible sole of the embodiment of FIG. 4A to 4C illustrates various features that may be interchangeable with elements of any other embodiment described in the specification. In some embodiments, collapsible sole 200 comprises top side 202. Top side 202 faces upwardly, relative to collapsible sole 200. In some embodiments, collapsible sole 200 further comprises bottom side 204. Bottom side 204 faces downwardly, relative to collapsible sole 200.

In some embodiments, collapsible sole 200 embodies a telescopic assembly. The telescopic assembly of collapsible sole 200 comprises a plurality of structural segments 206. The exterior contour of structural segments 206 is optionally racetrack-shaped and foot-like shaped. In some embodiments, each one of plurality of structural segments 206 comprises anterior portion 208 and posterior portion 210.

In some embodiments, each one of plurality of structural segments 206 of collapsible sole 200 further comprises a longitudinally extending channel or interior lumen. The longitudinally extending channel of each one of plurality of structural segments 206 is formed in-between anterior portion 208 and posterior portion 210 and in-between top side 202 and side sheet 204.

In some embodiments, collapsible sole 200 is characterized by reversibly assuming a collapsed configuration and an erected configuration. In some embodiments, in a collapsed configuration, shown in FIG. 4A, anterior portions 208 of structural segments 206 are disposed adjacently to each other, whereas posterior portion 210 are disposed adjacently to each other, whilst structural segments 206 are telescoped and accommodated within adjacent sections 206. For instance, in a collapsed configuration, shown in FIG. 4A, posterior portion 210 of first structural segment 206 is adjacent to posterior portion 210 of adjacent structural segment 206, whereas anterior portion 208 of first structural segment 206 is adjacent to anterior portion 208 of adjacent structural segment 208.

In an erected configuration, shown in FIG. 4A, the plurality of structural segments 206 are spaced apart from each other, so that posterior portion 210 of structural segment 206 is spaced apart from posterior portion 210 of adjacent structural segment 206, whereas anterior portion 208 of structural segment 206 is spaced apart from anterior portion 208 of adjacent structural segment 208.

In some examples, collapsible sole 200 comprises five structural segments 206A, 206B, 206C, 206D and 206E. In a collapsed configuration, first structural segment 206A telescopes within the laterally extending channel of second structural segment 206B. Similarly, second structural segment 206B telescopes within the laterally extending channel of third structural segment 206C. Second structural segment 206C telescopes within the laterally extending channel of forth structural segment 206D, which is in turn telescoped within the laterally extending channel of fifth structural segment 206E.

In some embodiments, collapsible sole 200 further comprises top pat 210. In some examples, top part 210 is a removable top part. In some embodiments, top part 210 further comprises a plurality of connecting elements 212. Connecting elements 212 are configured for readily connecting collapsible sole 200 with top part 210 and readily disconnecting collapsible sole 200 from top part 210. Each of connecting elements of top part 210 is connectable to a corresponding connecting element, such as securing aperture 214, of collapsible sole 200, thereby securing top part 210 with collapsible sole 200.

Figure 5A:
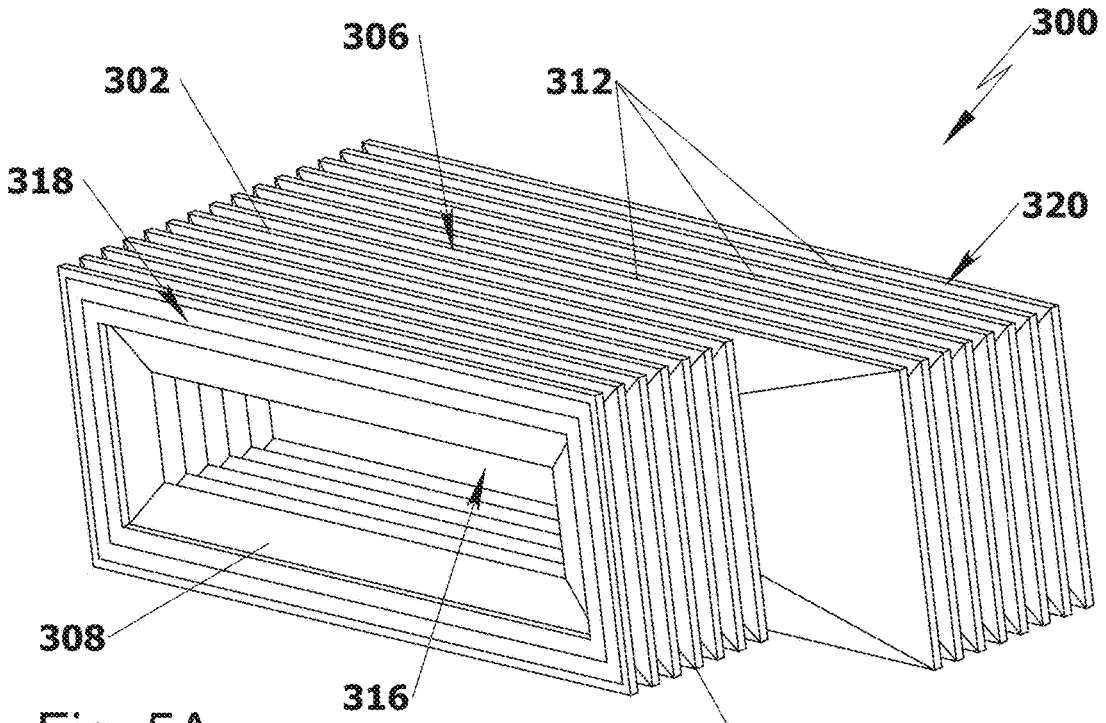
FIG. 5A is a perspective view of a collapsible sole in a collapsed configuration, according to some embodiment of the present invention.
Figure 5B:
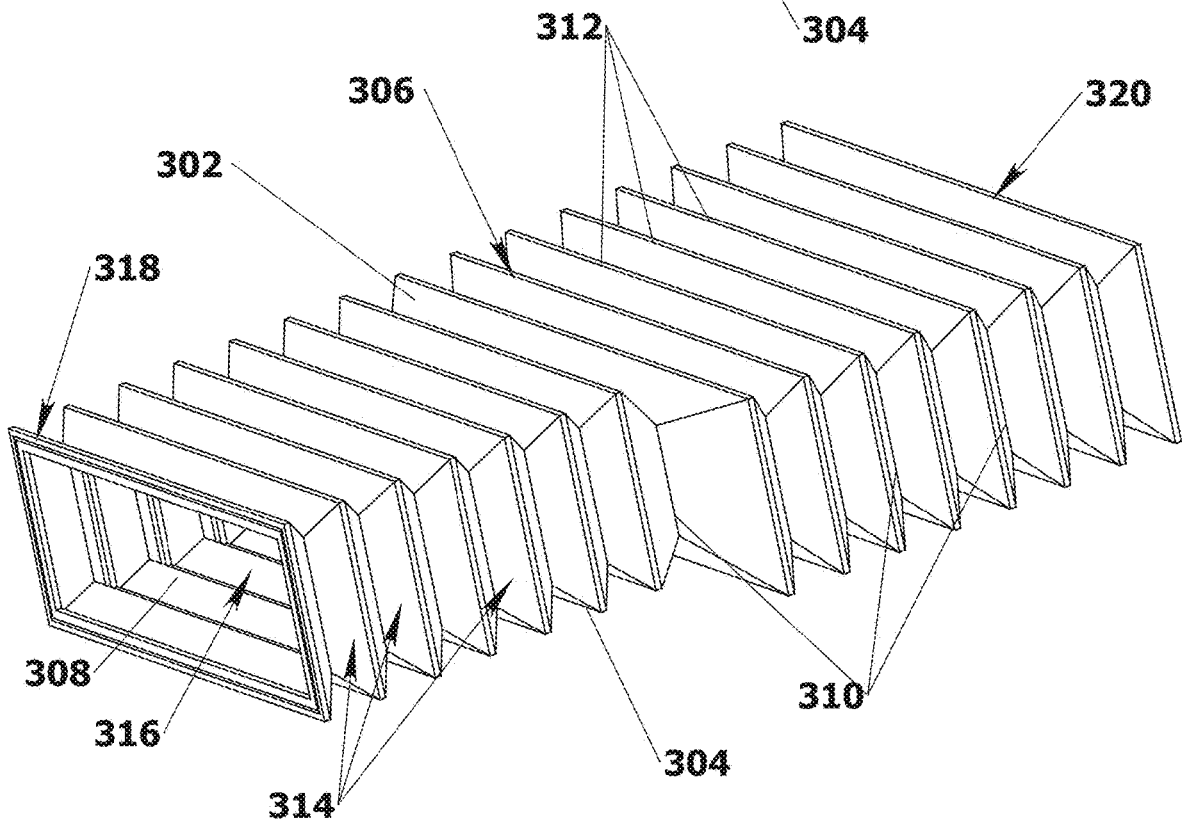
FIG. 5B is a perspective view of a collapsible sole in an erected configuration, according to some embodiment of the present invention.
Figure 6:
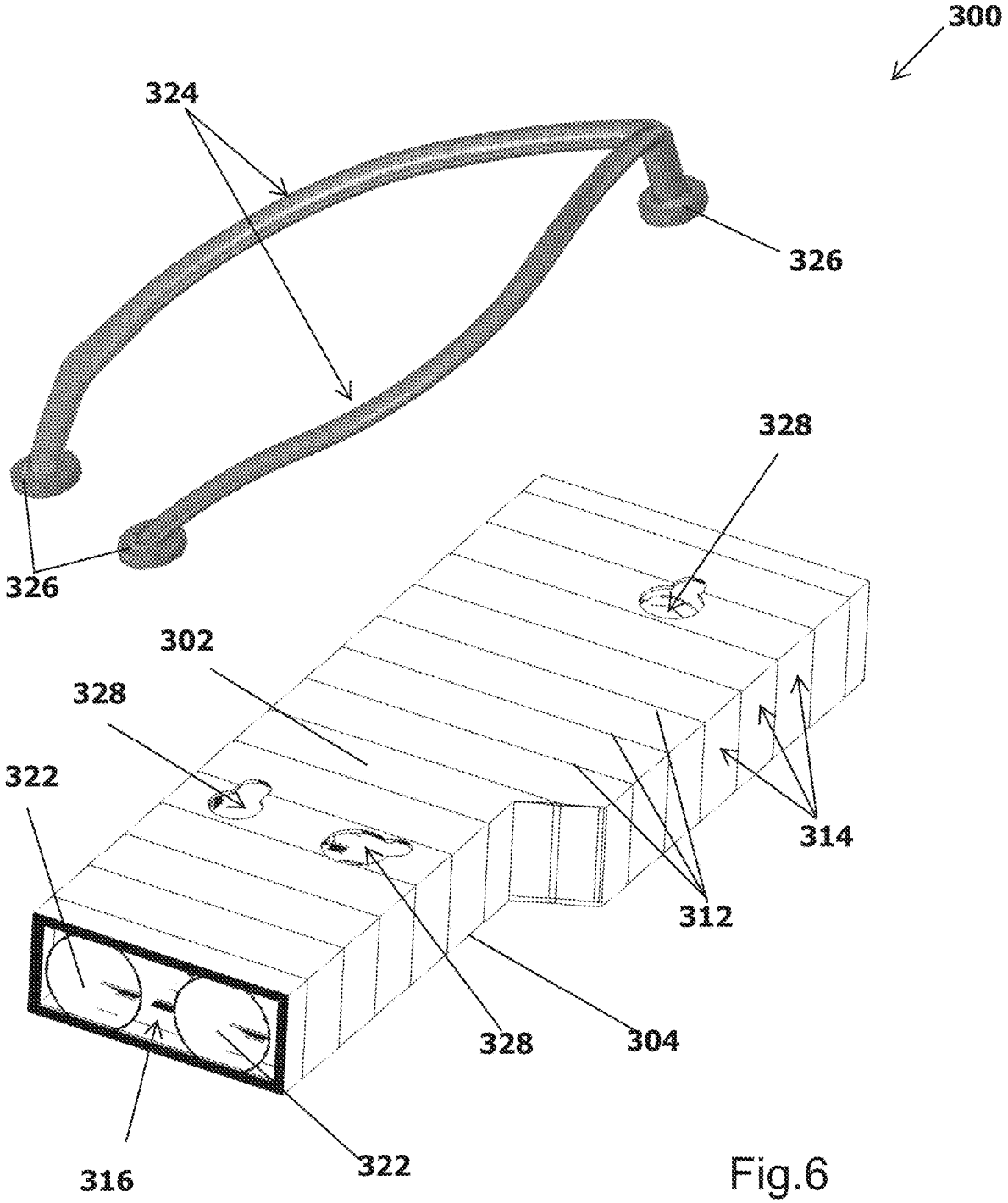
FIG. 6 is a perspective view of a collapsible sole in an erected configuration, according to some embodiment of the present invention.

In accordance with some preferred embodiments of the present invention, reference is now made to FIG. 5A to 6, showing still another embodiment of the invention, showing collapsible sole 300 of a collapsible footwear. The collapsible sole of the embodiment of FIGS. 5A and 5C illustrates various features that may be interchangeable with elements of any other embodiment described in the specification. In some embodiments, collapsible sole 300 comprises top sheet 302 and bottom sheet 304. In some embodiments, top sheet 302 and bottom sheet 304 of collapsible sole 300 are configured for reversibly assuming a corrugated shape.

In some embodiments, exterior surface 306 and interior surface 308 of collapsible sole 300 further comprise a plurality of corrugations, including interior folds 310 and exterior folds 312. Interior folds 306 are connected to exterior folds 312 by a plurality of lateral elements 314.

In some embodiments, collapsible sole 200 further comprises longitudinally extending channel 316. Longitudinally extending channel 316 extends along an entire length of collapsible sole 300. Longitudinally extending channel 316 of collapsible sole 300 is formed in-between anterior portion 318 and posterior portion 320 of collapsible sole 200 and in-between top sheet 302 and bottom sheet 304 of collapsible sole 200.

In some embodiments, collapsible sole 300 further comprises at least one stopper element 322, shown in FIG. 6. At least one stopper element 322 is disposable between top sheet 302 and bottom sheet 304. In some examples, at least one stopper element 322 embodies the shape of extendible telescopic cylindrical assembly. In some embodiments, at least one stopper element 322 is insertable into longitudinally extending channel 316 of collapsible sole 300.

In some embodiments, collapsible sole 300 is characterized by reversibly assuming a collapsed configuration and an erected configuration. In some embodiments, in an erected configuration, at least one stopper element 322 inserted into longitudinally extending channel 316 and stabilizes collapsible sole 300 in an open conformation, so that top sheet 302 and bottom sheet 304 assume an essentially straight and/or planar shape. In some embodiments, in an erected configuration, the angle formed between interior folds 310 to exterior folds 312 is an essentially straight angle.

In some embodiments, in a collapsed configuration, longitudinally extending channel 316 is collapsed, so that lateral support elements 314 are adjacent disposed adjointly one to another. In some embodiments, in a collapsed configuration, the angle formed between interior folds 310 to exterior folds 312 is an essentially acute angle.

In some embodiments, collapsible sole 200 further comprises top pat 324. In some examples, top part 324 is a removable top part. In some embodiments, top part 324 further comprises a plurality of connecting elements 326. In some embodiments, connecting elements 326 are configured for readily connecting collapsible sole 300 with top part 324 and readily disconnecting collapsible sole 300 from top part 324. Each of connecting elements of top part 324 is connectable to a corresponding connecting element, such as securing aperture 328, of collapsible sole 300, thereby facilitating the reversibly securing of top part 324 to collapsible sole 300.

Figure 7:
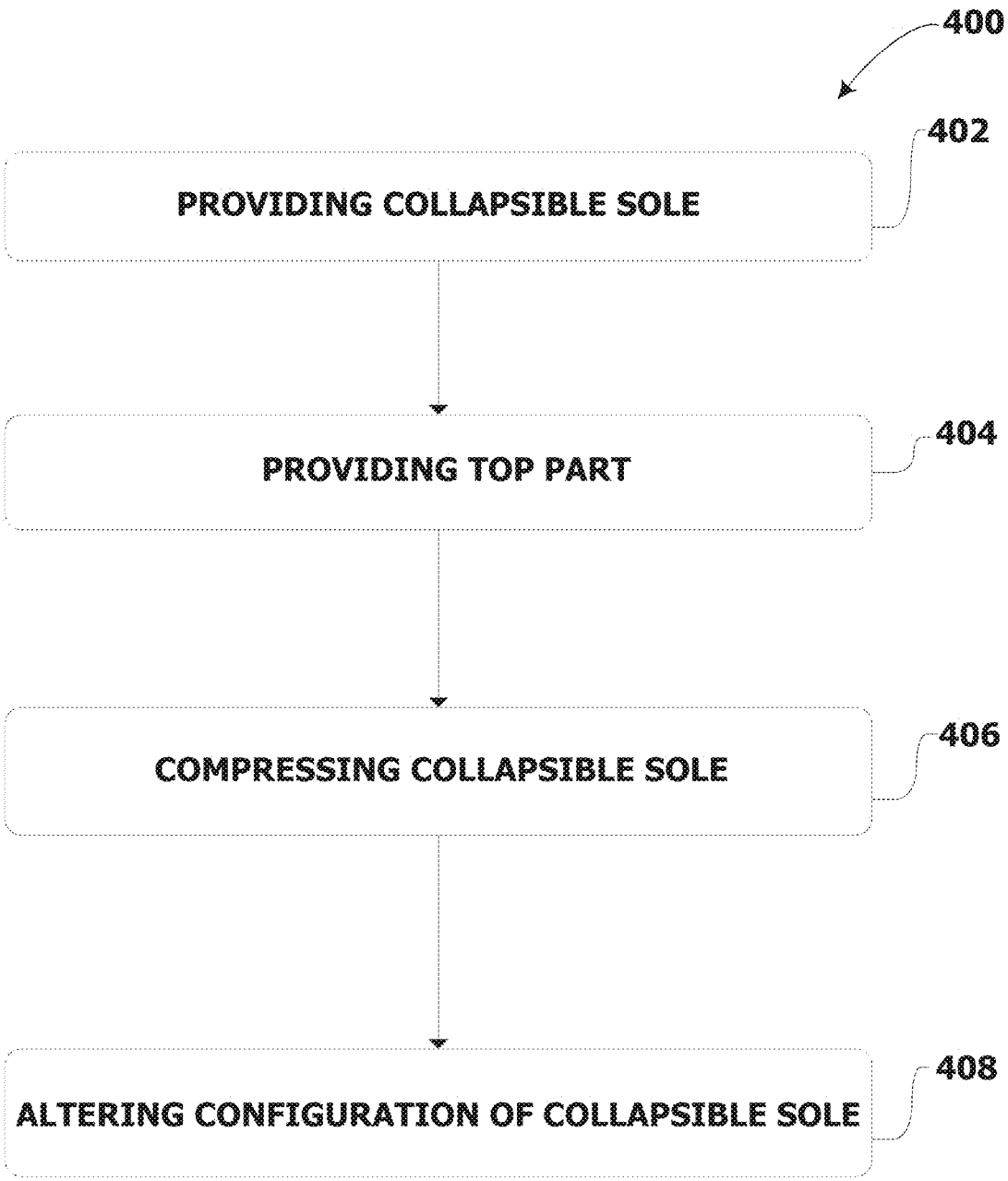
FIG. 7 is a flowchart of a method of altering a configuration of a collapsible footwear into a compact form, configured for transportation, according to another embodiment of the present invention.

In accordance with some embodiments of the present invention, reference is now made FIG. 7 showing flowchart of method 400 of altering a configuration of a collapsible footwear into a compact form, configured for transportation. The method of the embodiment of FIG. 7 illustrates various features that may be interchangeable with elements of any other embodiment described in the specification.

In some embodiments, method 400 commences at step 402 of providing a collapsible sole. In some embodiments, the collapsible sole comprises a top sheet, extending essentially across entire surface area of the sole and a bottom sheet, extending essentially across entire surface area of the sole. In some embodiments, the collapsible sole comprises further comprises a plurality of lateral support elements, extending in-between the top sheet and the bottom sheet, in which the lateral support elements extend essentially along an entire width of the sole.

In some embodiments, the collapsible sole further comprises a plurality of laterally extending channels formed in-between the lateral support elements and in-between the top and bottom sheets. In some embodiments, the collapsible sole further comprises a plurality of top and bottom hinge elements operationally connecting the top and bottom sheet to the respective of lateral support elements of the collapsible sole, in which the top and bottom hinge elements are configured to sustain a partial rotation of the plurality of lateral support elements relative to the top and bottom sheet. In some embodiments, the collapsible sole further comprises at least one stopper element disposable between the upper sheet and the bottom sheet.

In some embodiments, the collapsible sole is essentially similar to collapsible soles 10, 50, 100, 200 and/or 300, shown in FIG. 1A to 6 and described hereinabove. In some embodiments, step 402 further comprises inserting at least one stopper element within said at least one of laterally extending channel, allowing the collapsible sole to be in an erected configuration.

In some embodiments, method 400 comprises step 404 of providing at least one top part. In some embodiments, the top part is a collapsible top part and/or a removable top part. In some embodiments, step 404 of providing at least one top part further comprises the step of connecting the collapsible sole with the top part.

In some embodiments, method 400 further includes step 406 of compressing the collapsible sole to assume a collapsed configuration, in which the plurality of laterally extending channels is essentially collapsed and the top sheet is brought into proximity with the bottom sheet and/or the top sheet and the bottom sheet assume a corrugated form or conformation. In some embodiments, step 406 further comprises step of forming an essentially acute angle between the plurality of lateral support elements and the top and bottom sheet and/or between interior folds and exterior folds of the collapsible sole, facilitating bringing the top sheet into proximity with the bottom sheet and/or the top sheet and the bottom sheet assuming a corrugated form or conformation and thereby rendering the collapsible sole collapsed and/or compressed.

In some embodiments, method 400 further comprises step 408 of altering a configuration of the collapsible sole to assume an erected configuration, in which at least one stopper element stabilizes the plurality of laterally extending channels in an open conformation, whereas the top sheet is spaced apart from the bottom sheet and/or top sheet and bottom sheet assume an essentially straight and/or planar form.

In some embodiments, the collapsible sole comprises a frontal portion, a centrical portion and a rear portion, such as in the embodiments shown in FIG. 2A to 2F. In such embodiments, step 406 of method 400 that includes compressing the collapsible sole to assume a collapsed configuration, optionally further includes the folding the collapsible sole to assume a folded configuration, in which in the collapsed configuration, the bottom sheet of the collapsible sole is folded about the centrical portion, so that a frontal portion of the bottom sheet is disposed adjacently to a rear portion of the bottom sheet.

In such embodiments, step 408 of method 400 that includes altering the configuration of the collapsible sole to assume an erected configuration, optionally further includes the altering a configuration of the collapsible sole to assume an unfolded configuration, in which in the unfolded configuration, the bottom sheet of the collapsible sole is straightened, so that the frontal portion of the bottom sheet forming an approximately straight angle relative to the rear portion of the bottom sheet.

In some embodiments, the centrical portion accommodates at least one stopper element comprising an essentially trapezoid shape, such as in the embodiments shown in FIG. 2A to 2F. In such embodiments, step 406 of method 400 that includes compressing the collapsible sole to assume a collapsed configuration, optionally further includes the folding the collapsible sole to assume a folded configuration, in which in the folded configuration, the posterior top hinge elements are spaced apart from a top portion of the trapezoidally shaped stopper element.

In some embodiments, step 408 of method 400 that includes altering the configuration of the collapsible sole to assume an erected configuration, optionally further includes the step of altering a configuration of the collapsible sole to assume an unfolded configuration, in which in the unfolded configuration, the top hinge elements are adjoined to the top portion of the trapezoid shape.

INDEX OF REFERENCE NUMERALS

Within the specification hereinabove inter alia the following numerals were used to denote the particular constituents in the appended drawings:

10—collapsible sole
12—top sheet
14—bottom sheet
16—lateral support elements
18—laterally extending channels
20—top hinge elements
22—bottom hinge elements
24—at least one stopper element
50—collapsible sole
52—top sheet
52A—frontal portion
52B—rear portion
54—bottom sheet
56—lateral support elements
58—laterally extending channels
60—top hinge elements
62—bottom hinge elements
64—at least one stopper element
66—trapezoid shape
68—centrical portion
70A—posterior top hinge element
70B—posterior top hinge element
72—top portion of trapezoid shape
100—collapsible sole
102—top sheet
104—bottom sheet
106—lateral support elements
108—laterally extending channels
110—top hinge elements
112—bottom hinge elements
114—stopper element
116—top stopper hinge portions
118—bottom stopper hinge portions
120—first portions of top sheet
122—second portions of top sheet
124—first portions of bottom sheet
126—second portions of bottom sheet
200—collapsible sole
202—top side
204—bottom side
206—structural segments
208—anterior portion
210—posterior portion
212—connecting elements
214—securing aperture
300—collapsible sole
302—top sheet
304—bottom sheet
306—exterior surface
308—interior surface
310—interior folds
312—exterior folds
314—support elements
316—longitudinally extending channel
318—anterior portion
320—posterior portion
322—at least one stopper element
400—method of altering a configuration of a collapsible footwear
402—providing a collapsible sole
404—providing at least one top part
406—compressing the collapsible sole
408—altering a configuration of the collapsible sole It will be appreciated by persons skilled in the art of the invention that various features and/or elements elaborated in the context of a specific embodiment described hereinabove and/or referenced herein and/or illustrated by a particular example in a certain drawing enclosed hereto, whether method, system, device or product, is/are interchangeable with features and/or elements of any other embodiment described in the specification and/or shown in the drawings.

Moreover, skilled persons would appreciate that the present invention is not limited by what has been particularly shown and described hereinabove. Rather the scope of the invention is defined by the claims which follow:

The invention claimed is:

1. A collapsible footwear configured for transportation in a compact form comprises:

(a) a collapsible sole comprising:

(I) a top sheet, extending essentially across entire surface area of said sole;

(II) a bottom sheet, extending essentially across entire surface area of said sole;

(III) a plurality of lateral support elements, extending between said top sheet and said bottom sheet;

wherein said lateral support elements extend essentially along an entire width of said sole;

(IV) a plurality of laterally extending channels formed in-between said lateral support elements and in-between said top and bottom sheets;

(V) a plurality of top hinge elements operationally connecting said top sheet and said plurality of lateral support elements of said collapsible sole, wherein said top hinge elements are configured to sustain a partial rotation of said plurality of lateral support elements relative to said top sheet;

(VI) a plurality of bottom hinge elements operationally connecting said bottom sheet and said plurality of lateral support elements of said collapsible sole, wherein said bottom hinge elements are configured to sustain a partial rotation of said plurality of lateral support elements relative to said bottom sheet;

(VII) at least one stopper element disposable between said upper sheet and said bottom sheet;

wherein said collapsible sole is characterized by reversibly assuming:

(i) a collapsed configuration, wherein said plurality of laterally extending channels is essentially collapsed and said top sheet is at least one member selected from the group consisting of: in a proximity to said bottom sheet and spaced apart from said bottom sheet;

(ii) an erected configuration, wherein said at least one stopper element stabilizes said plurality of laterally extending channels in an open conformation, whereas said top sheet is at least one member selected from the group consisting of: spaced apart from said bottom sheet and comprises a straight planar form;

(b) at least one top part, selected from the group consisting of:

a collapsible top part;

(ii) a removable top part.

2. The collapsible footwear as in claim 1, wherein said at least one top part is said removable top part, further comprises a plurality of connecting elements, configured for readily connecting said collapsible sole with said at least one top part.

3. The collapsible footwear as in claim 1, wherein said at least one stopper element disposable between said upper sheet and said bottom sheet embodies linear shape.

4. The collapsible footwear as in claim 1, wherein said plurality of laterally extending channels are essentially collapsed, by forming an acute angle between said plurality of lateral support elements and said top sheet and bottom sheet, thereby disposing said top sheet within proximity to said bottom sheet.

5. The collapsible footwear as in claim 1, wherein in said erected configuration, said plurality of lateral support elements are disposed essentially perpendicularly to said top sheet and said bottom sheet.

6. The collapsible footwear as in claim 1, wherein said at least one stopper element is insertable within at least one of said laterally extending channels, thereby affixing said collapsible sole in said erected configuration, and wherein said at least one stopper element is retrievable from said at least one of said laterally extending channels, thereby rendering said collapsible sole alterable into said collapsed configuration.

7. The collapsible footwear as in claim 1, wherein said plurality of lateral support elements are positioned relative to said upper sheet and said bottom sheet at an angle selected form the group consisting of: perpendicular angle, acute angle, obtuse angle.

8. The collapsible footwear as in claim 1, wherein said collapsible sole comprises a frontal portion, a centrical portion and a rear portion, wherein said collapsible sole to assume:

(a) a folded configuration, wherein in said collapsed configuration, said bottom sheet of said collapsible sole is folded about said centrical portion, so that a frontal portion of said bottom sheet is disposed adjacently to a rear portion of said bottom sheet;

(b) an unfolded configuration, wherein in said erected configuration, said bottom sheet of said collapsible sole is straightened, so that said frontal portion of said bottom sheet forming an approximately straight angle relative to said rear portion of said bottom sheet;

wherein said centrical portion accommodating a mechanism configured to affix said collapsible sole in said erected configuration.

9. The collapsible footwear as in claim 1, wherein said collapsible sole comprises a frontal portion, a centrical portion and a rear portion, wherein said centrical portion accommodating said at least one stopper element comprising an essentially trapezoid shape, wherein said collapsible sole is configured to assume:

(a) a folded configuration, wherein top hinge elements are spaced apart from a top portion of said trapezoid shape;

(b) an unfolded configuration, wherein said posterior top hinge elements are adjoined to said top portion of said trapezoid shape.

10. The collapsible footwear as in claim 1, wherein each one of said laterally extending channels accommodates a stopper element of a linear shape extending essentially along an entire width of said collapsible sole, selected from the group consisting of:

(a) a top stopper element comprising a connection between a top portion of said at least one stopper element and said top sheet, and (b) a bottom stopper element comprising a connection between a bottom portion of said stopper element and said bottom sheet.

11. The collapsible footwear as in claim 1, wherein said collapsible sole comprises a corrugated shape, wherein in said collapsed configuration, said top sheet and said bottom sheet of said collapsible sole are disposed adjacently to said stopper element.

12. The collapsible footwear as in claim 1, wherein in said erected configuration, said top sheet and bottom sheet of said collapsible sole assume an essentially planar form.

13. A method of altering a configuration of a collapsible footwear into a compact form, configured for transportation, comprises:

(a) providing a collapsible sole comprising:

(I) a top sheet, extending essentially across entire surface area of said sole;

(II) a bottom sheet, extending essentially across entire surface area of said sole;

(III) a plurality of lateral support elements, extending between said top sheet and said bottom sheet;

wherein said lateral support elements extend essentially along an entire width of said sole;

(IV) a plurality of laterally extending channels formed in-between said lateral support elements and in-between said top and bottom sheets;

(V) a plurality of top hinge elements operationally connecting said top sheet and said plurality of lateral support elements of said collapsible sole, wherein said top hinge elements are configured to sustain a partial rotation of said plurality of lateral support elements relative to said top sheet;

(VI) a plurality of bottom hinge elements operationally connecting said bottom sheet and said plurality of lateral support elements of said collapsible sole, wherein said bottom hinge elements are configured to sustain a partial rotation of said plurality of lateral support elements relative to said bottom sheet;

(VII) at least one stopper element disposable between said upper sheet and said bottom sheet:

(b) providing at least one top part, selected from the group consisting of:
(i) a collapsible top part;
(ii) a removable top part;
(c) compressing said collapsible sole to assume a collapsed configuration, wherein said plurality of laterally extending channels is essentially collapsed;
wherein said top sheet is in a proximity to said bottom sheet or comprising a corrugated shape;
(d) altering a configuration of said collapsible sole to assume an erected configuration, wherein said at least one stopper element stabilizes said plurality, of laterally extending channels in an open conformation;
wherein said top sheet is spaced apart from said bottom sheet and comprises an essentially planar shape.

14. The method as in claim 13, wherein said at least one top part is said removable top part, wherein said collapsible sole comprising a plurality of connecting elements, configured for readily connecting said collapsible sole with said at least one top part, further comprises connecting said collapsible sole with said at least one top part.

15. The method as in claim 13, further comprises inserting said at least one stopper element into said at least one of laterally extending channel, thereby affixing said collapsible sole in said erected configuration.

16. The method as in claim 13, further comprises forming an acute angle between said plurality of lateral support elements and said top and bottom sheets, in said collapsed configuration, thereby disposing said top sheet within proximity to said bottom sheet.

17. The method as in claim 13, wherein said collapsible sole comprises a frontal portion, a centrical portion and a rear portion, further comprises:
(a) folding said collapsible sole to assume a folded configuration, wherein in said collapsed configuration, said bottom sheet of said collapsible sole is folded about said centrical portion, so that a frontal portion of said bottom sheet is disposed adjacently to a rear portion of said bottom sheet;
(b) altering a configuration of said collapsible sole to assume an unfolded configuration, wherein in said erected configuration, said bottom sheet of said collapsible sole is straightened to assume an essentially planar shape, so that said frontal portion of said bottom sheet forming an approximately straight angle relative to said rear portion of said bottom sheet.

18. The method as in claim 13, wherein said collapsible sole comprises a frontal portion, a centrical portion and a rear portion, wherein said centrical portion accommodating said at least one stopper element comprising an essentially trapezoid shape, further comprises:
(a) folding said collapsible sole to assume a folded configuration, wherein in said folded configuration, posterior top hinge elements are spaced apart from a top portion of said trapezoid shape;
(b) altering a configuration of said collapsible sole to assume an unfolded configuration, wherein in said erected configuration, said posterior top hinge elements are adjoined to said top portion of said trapezoid shape.

19. The method as in claim 13, wherein each one of said laterally extending channels accommodates said stopper element of a linear shape extending essentially along an entire width of said collapsible sole, further comprises:
(a) connecting a top portion of at least one top stopper element to said top sheet of said collapsible sole, and
(b) connecting a bottom portion of at least one bottom stopper element to said bottom sheet of said collapsible sole.

* * * * *